US012072119B2

(12) United States Patent
Hiroishi et al.

(10) Patent No.: US 12,072,119 B2
(45) **Date of Patent: *Aug. 27, 2024**

(54) AIR CONDITIONING SYSTEM

(71) Applicant: FH alliance Inc., Kasugai (JP)

(72) Inventors: Kazuro Hiroishi, Kasugai (JP); Mitsunori Matsubara, Kasugai (JP)

(73) Assignee: FH ALLIANCE INC., Kasugai (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/141,355

(22) Filed: Apr. 28, 2023

(65) Prior Publication Data

US 2023/0341145 A1 Oct. 26, 2023

Related U.S. Application Data

(62) Division of application No. 17/787,555, filed as application No. PCT/JP2020/012511 on Mar. 19, 2020, now Pat. No. 11,674,709.

(51) Int. Cl.
*F24F 11/76* (2018.01)
*F24F 3/048* (2006.01)
(Continued)

(52) U.S. Cl.
CPC ..... *F24F 11/76* (2018.01); *F24F 3/048* (2013.01); *F24F 11/58* (2018.01); *F24F 2110/10* (2018.01)

(58) Field of Classification Search
CPC .. F24F 11/76; F24F 11/58; F24F 3/048; F24F 2110/10
See application file for complete search history.

(56) References Cited

U.S. PATENT DOCUMENTS 3,169,382 A 2/1965 Brown
4,811,897 A 3/1989 Kobayashi
(Continued)

FOREIGN PATENT DOCUMENTS

JP H09-79648 A 3/1997
JP H09-280604 A 10/1997
(Continued)

OTHER PUBLICATIONS

Office Action of Japanese Patent Application No. 2020-555531: Notice of Reasons for Rejection dated Dec. 1, 2020, English translation (3 sheets).
(Continued)

*Primary Examiner* — Mohammad Ali
*Assistant Examiner* — Vincent W Chang
(74) *Attorney, Agent, or Firm* — Kratz, Quintos & Hanson, LLP

(57) ABSTRACT

In an air conditioning system, a return compartment which is adjacent to a plurality of rooms 13, 14, 15 is formed in a building 1, the respective rooms 13, 14, 15 are provided with air intake sections 18*a*, 18*b*, 18*c*, 18*d* which spout air sent from a blowing section 40*a*, 40*b*, 40*c* 40*d* having a DC motor, an exhaust section 52 which forms exhausting current directed from the respective rooms 13, 14, 15 toward the return compartment is provided between the respective rooms 13, 14, 15 and the return compartment, the plurality of blowing sections 40*a*, 40*b*, 40*c* 40*d* and at least one air conditioning section 30*a* are placed in the return compartment, a total blast volume of the plurality of blowing sections 40*a*, 40*b*, 40*c* 40*d* is greater than a conditioned air volume of the air conditioning section 30*a*, and a blast volume of the blowing section 40*a*, 40*b*, 40*c* 40*d* is adjusted by an air conditioning load of the room 13, 14, 15. According to this, it is possible to provide the air conditioning
(Continued)

system 29 having a relatively simple configuration, capable of changing temperature in the respective rooms 13, 14, 15 and coping with load variation caused by solar radiation if necessary, while comfortably and uniformly keeping temperature of the entire house with saved energy.

3 Claims, 15 Drawing Sheets

(51) Int. Cl.
*F24F 11/58* (2018.01)
*F24F 110/10* (2018.01)

(56) References Cited

U.S. PATENT DOCUMENTS

| | | | | |
|---|---|---|---|---|
| 5,673,851 | A | 10/1997 | Dozier | |
| 2020/0049367 | A1* | 2/2020 | Funada | F24F 13/1413 |
| 2020/0292198 | A1 | 9/2020 | Funada | |
| 2022/0113044 | A1 | 4/2022 | Ando | |
| 2022/0128256 | A1 | 4/2022 | Kanematsu | |
| 2022/0146123 | A1 | 5/2022 | Fujimoto | |
| 2022/0178576 | A1 | 6/2022 | Tanaka | |
| 2022/0349594 | A1 | 11/2022 | Sekizawa | |
| 2023/0160597 | A1* | 5/2023 | Lee | F24F 13/20 165/291 |

FOREIGN PATENT DOCUMENTS

| | | | |
|---|---|---|---|
| JP | 2012-057880 | A | 3/2012 |
| JP | 2018-109462 | A | 7/2018 |
| JP | 2019-039630 | A | 3/2019 |
| JP | 2019-174103 | A | 10/2019 |
| WO | 2018/073954 | A1 | 4/2018 |
| WO | 2019/107163 | A1 | 6/2019 |

OTHER PUBLICATIONS

International Search Report for International Application No. PCT/JP2020/012511 dated Jun. 16, 2020, English language (3 sheets).

Office Communication of Japanese Patent Application No. 2020-555531: Decision to Grant a Patent dated Apr. 22, 2021, with English translation (3 sheets).

* cited by examiner

[Fig. 1]
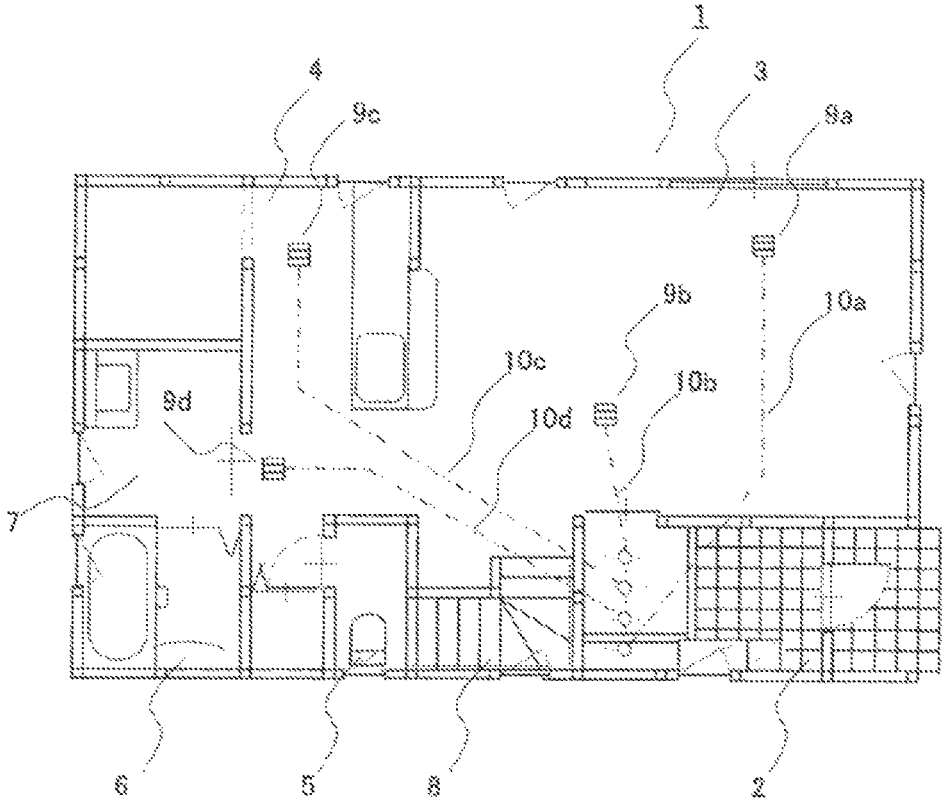

[Fig. 2]
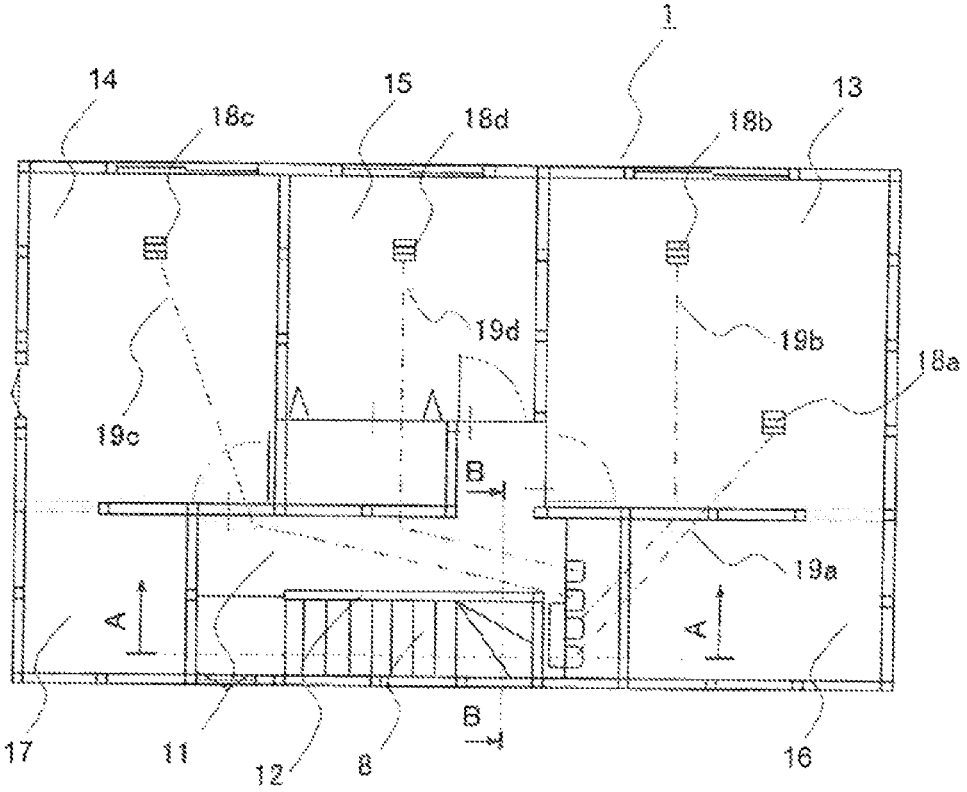

[Fig. 3]
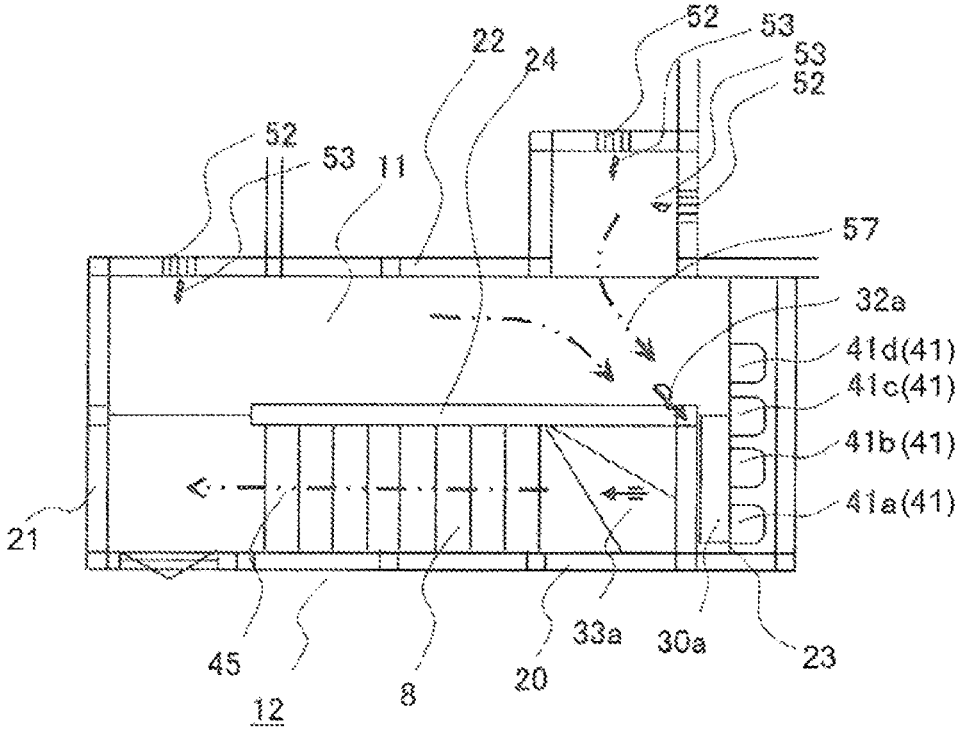

[Fig. 4]
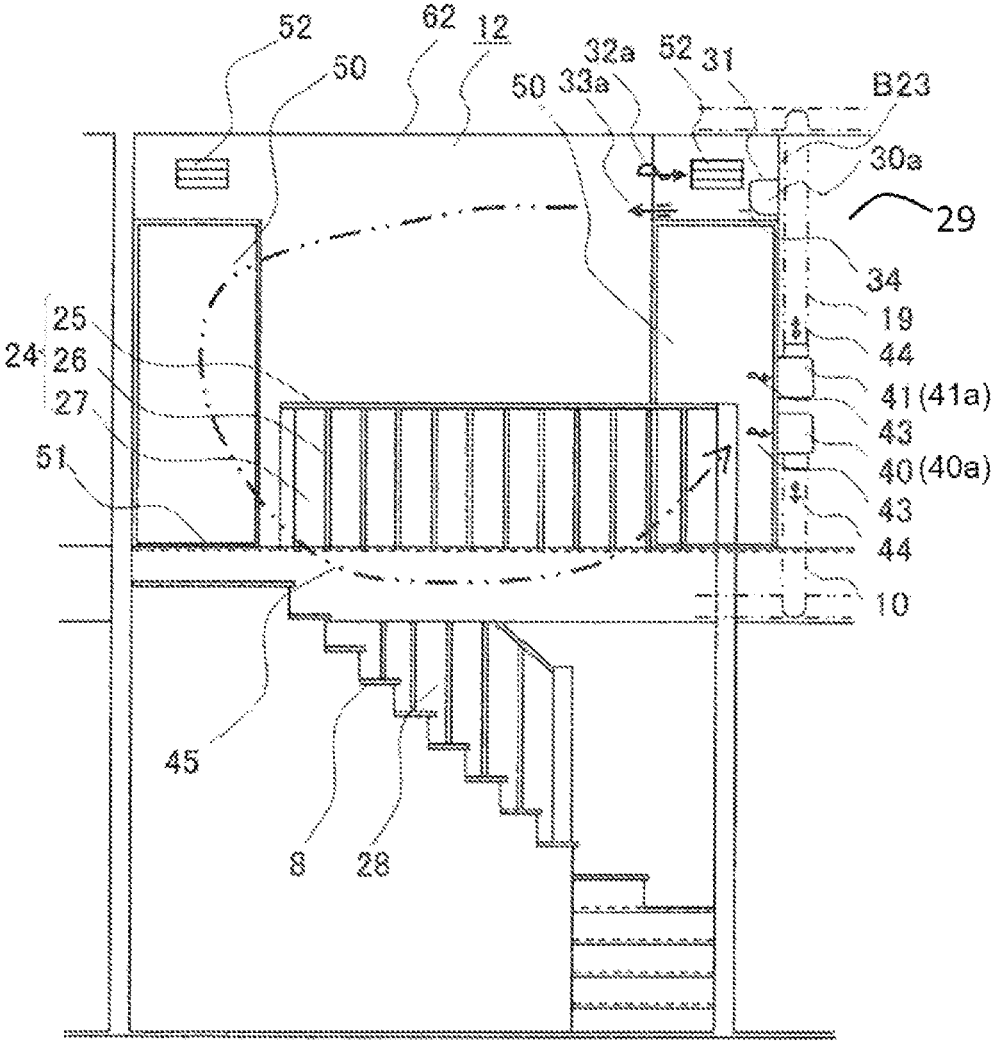

[Fig. 5]
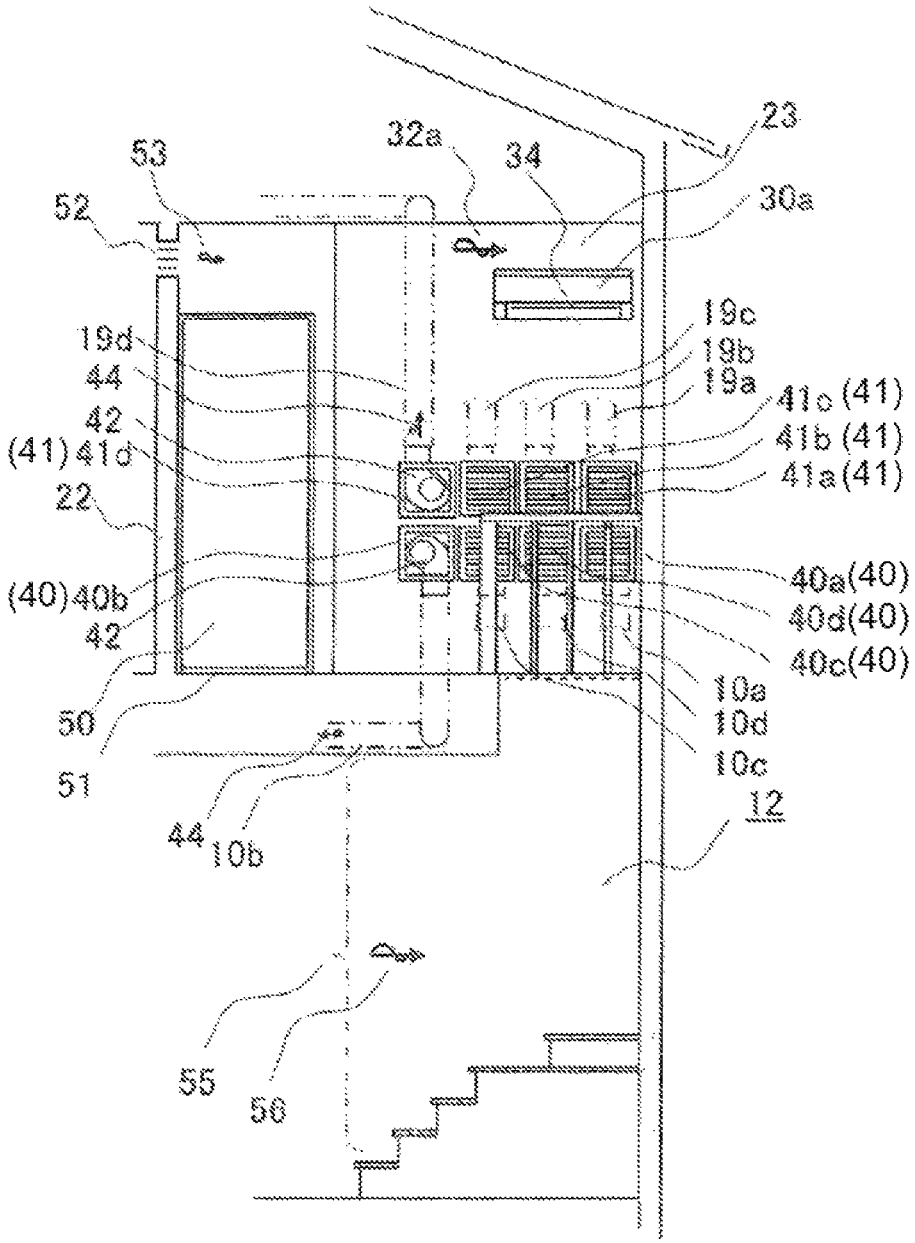

[Fig. 6]
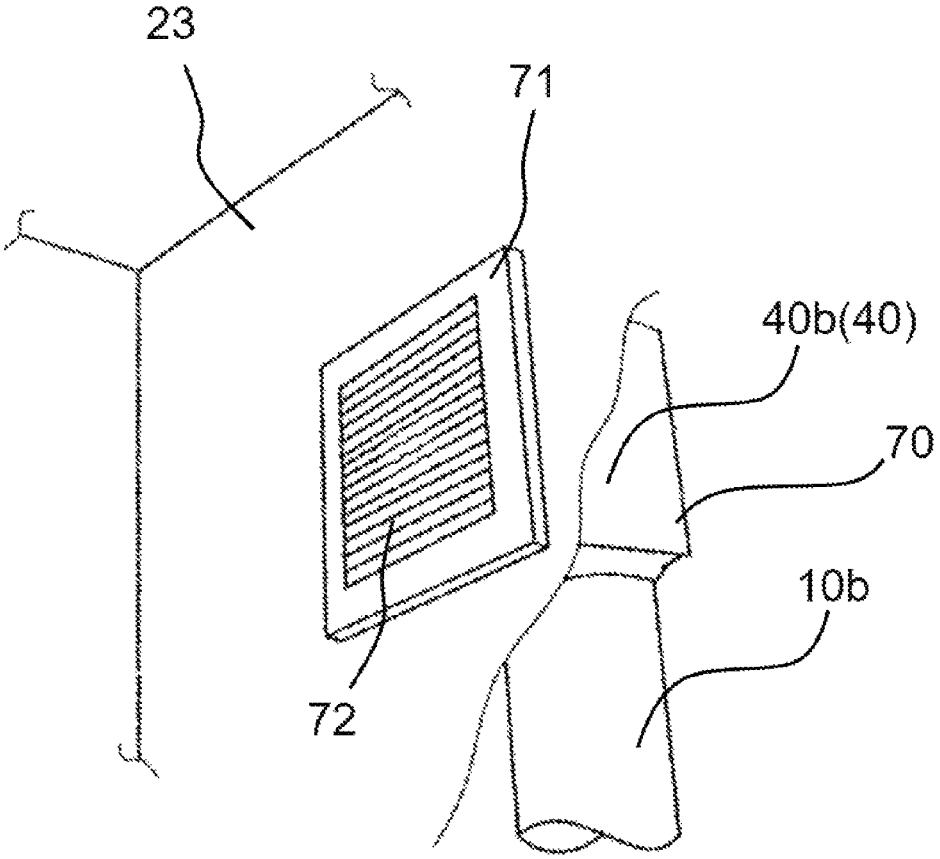

[Fig. 7]
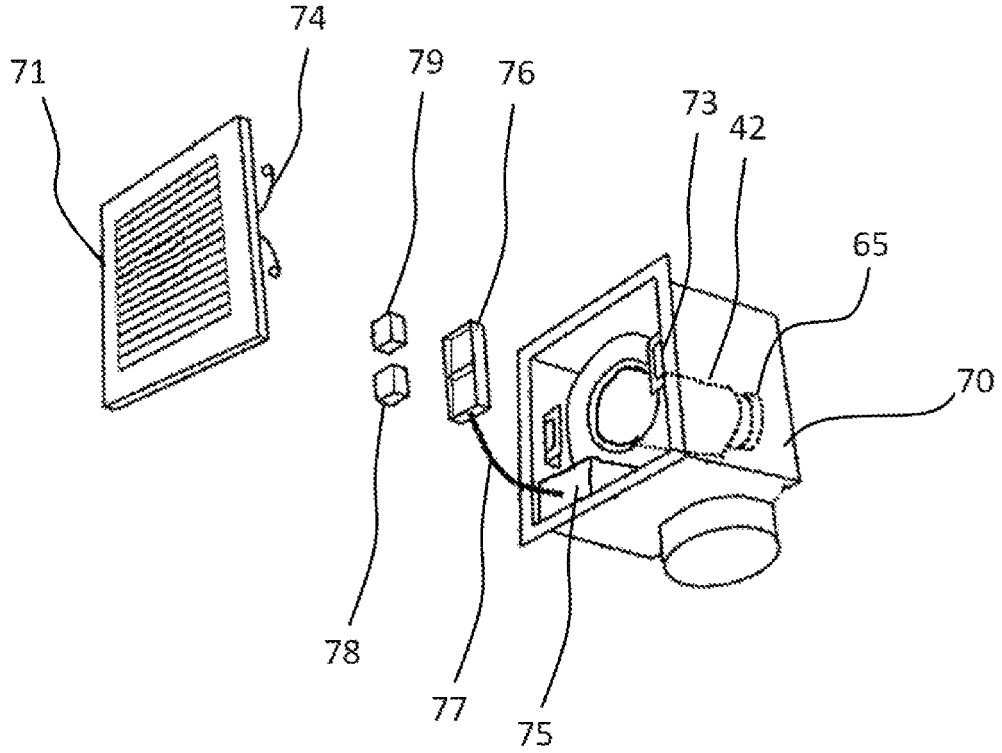

[Fig. 8]
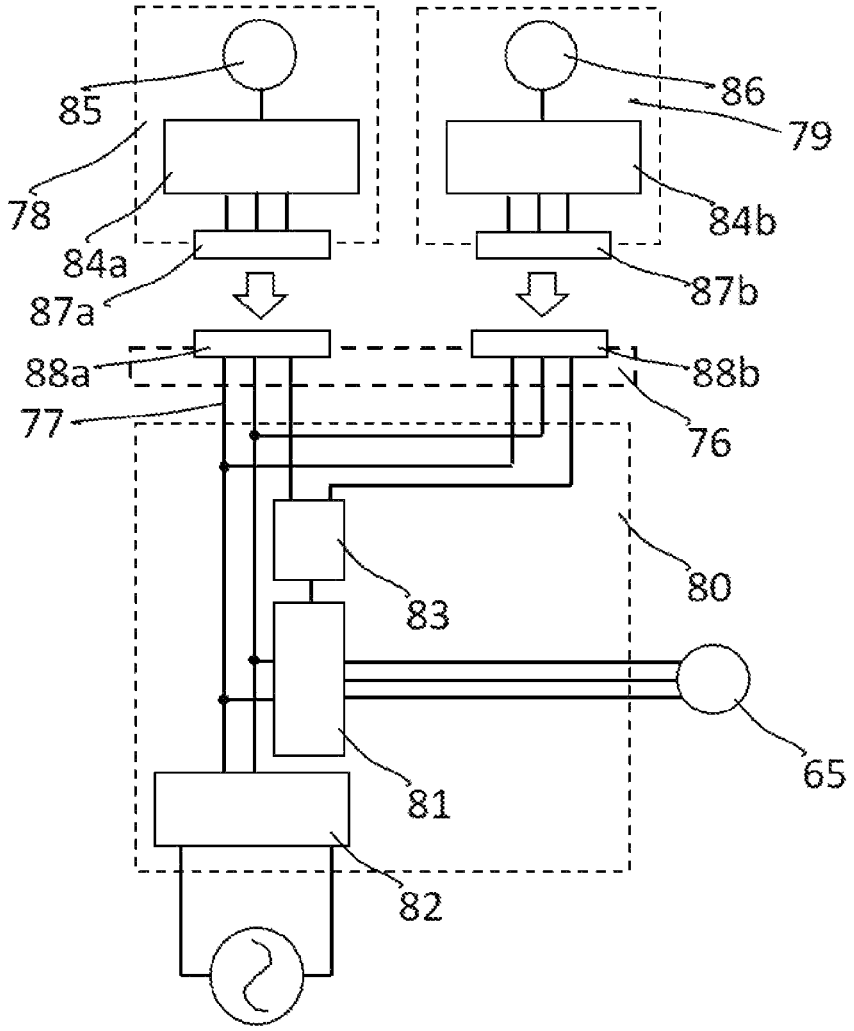

[Fig. 9]
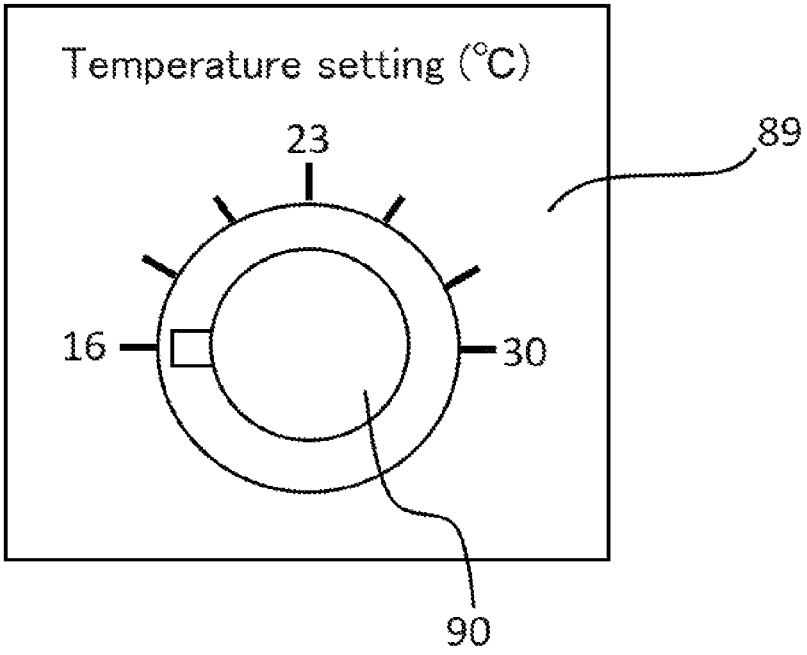

[Fig. 10]
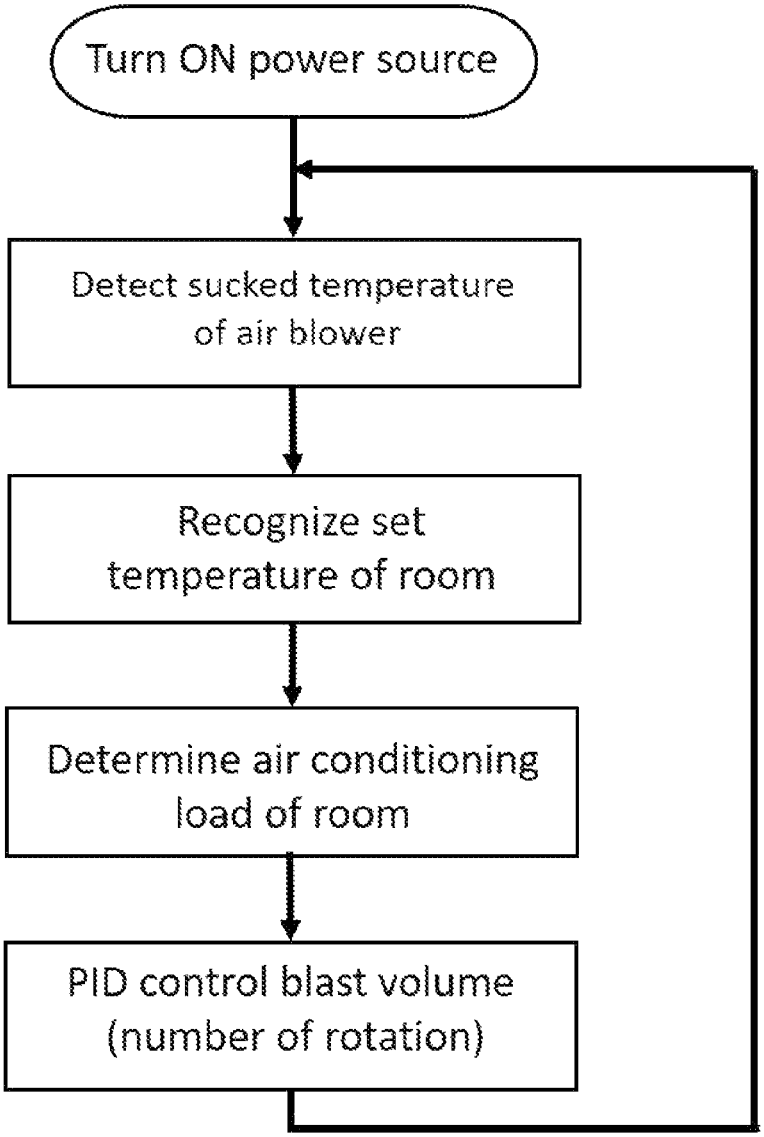

[Fig. 11]
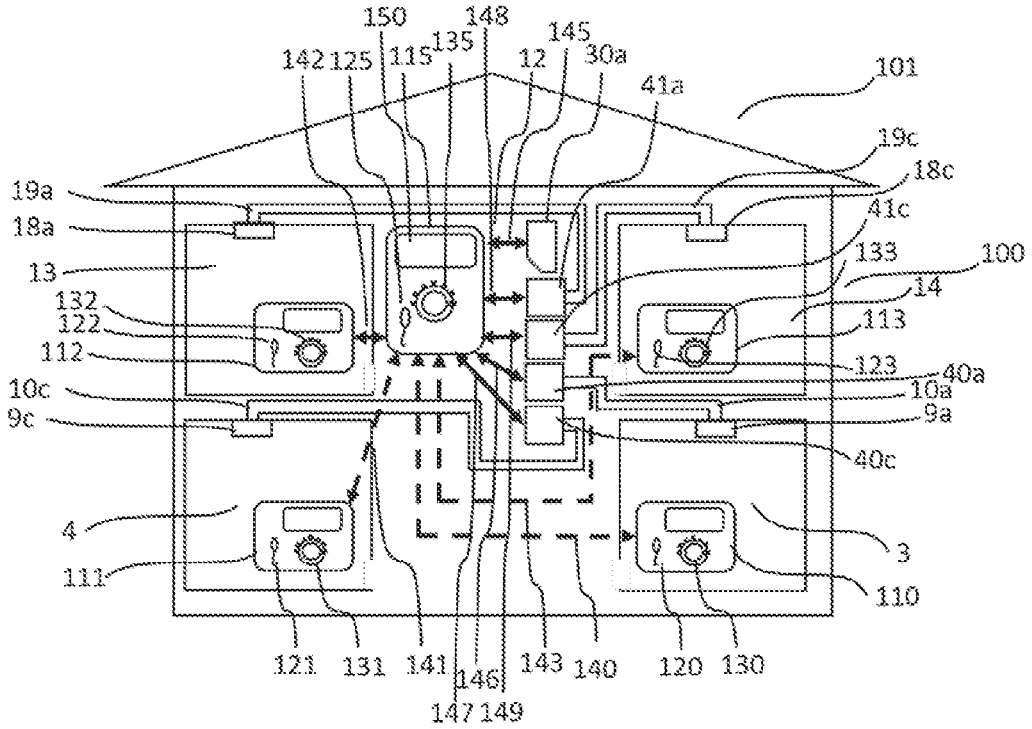

[Fig. 12]
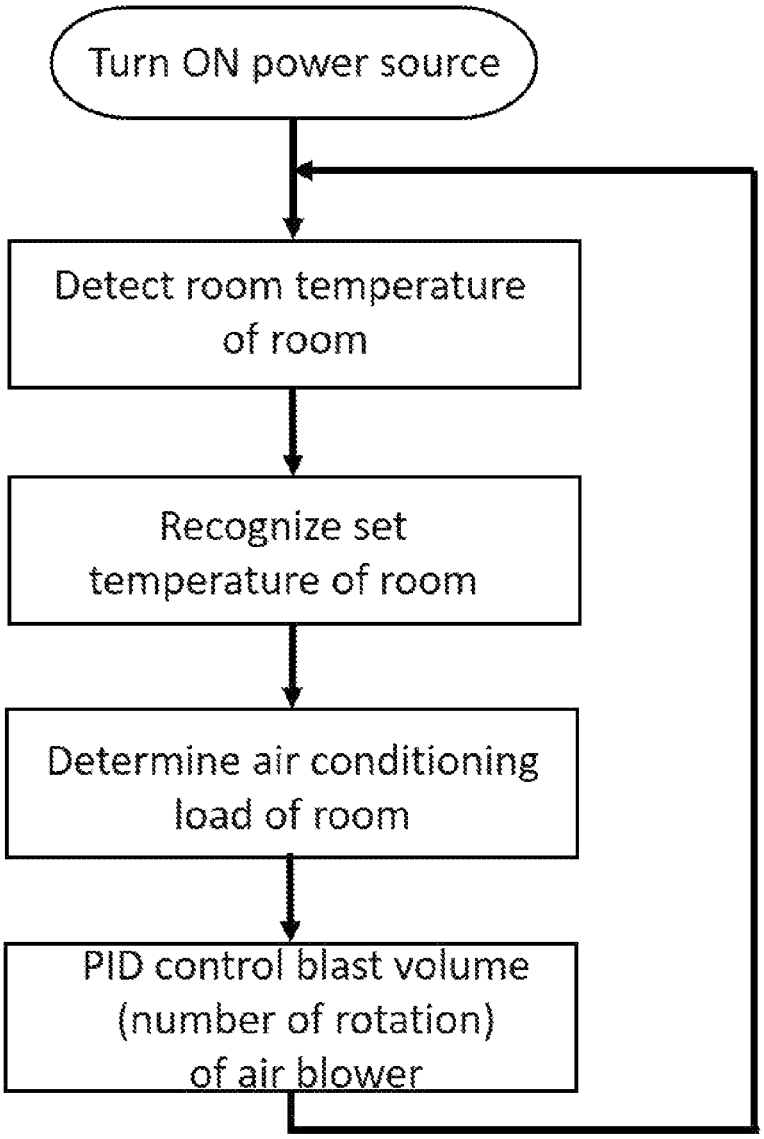

[Fig. 13]
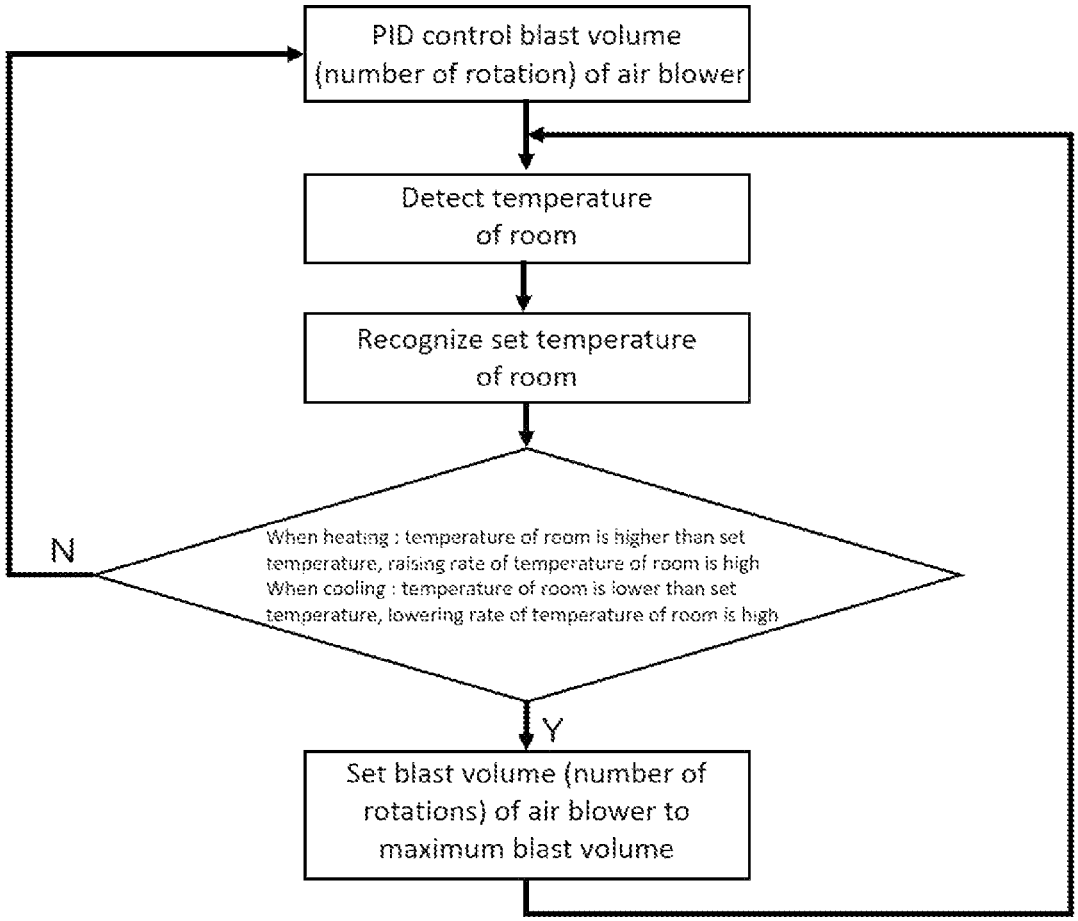

[Fig. 14]
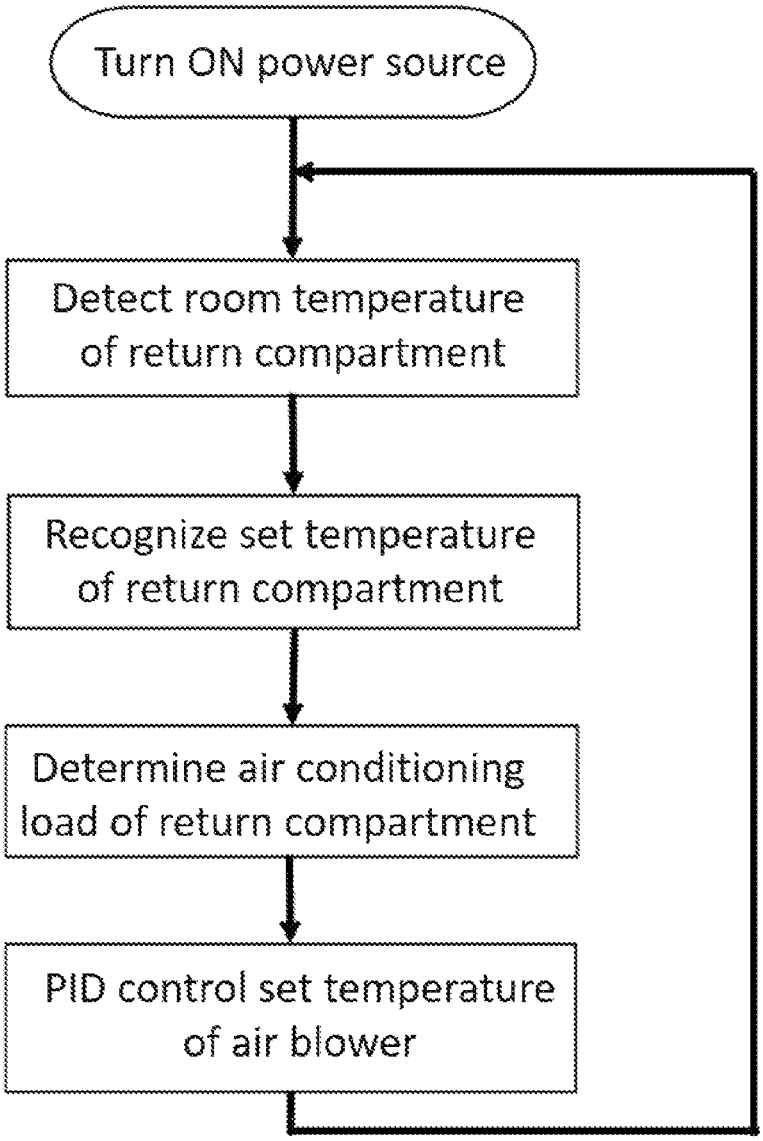

[Fig. 15]
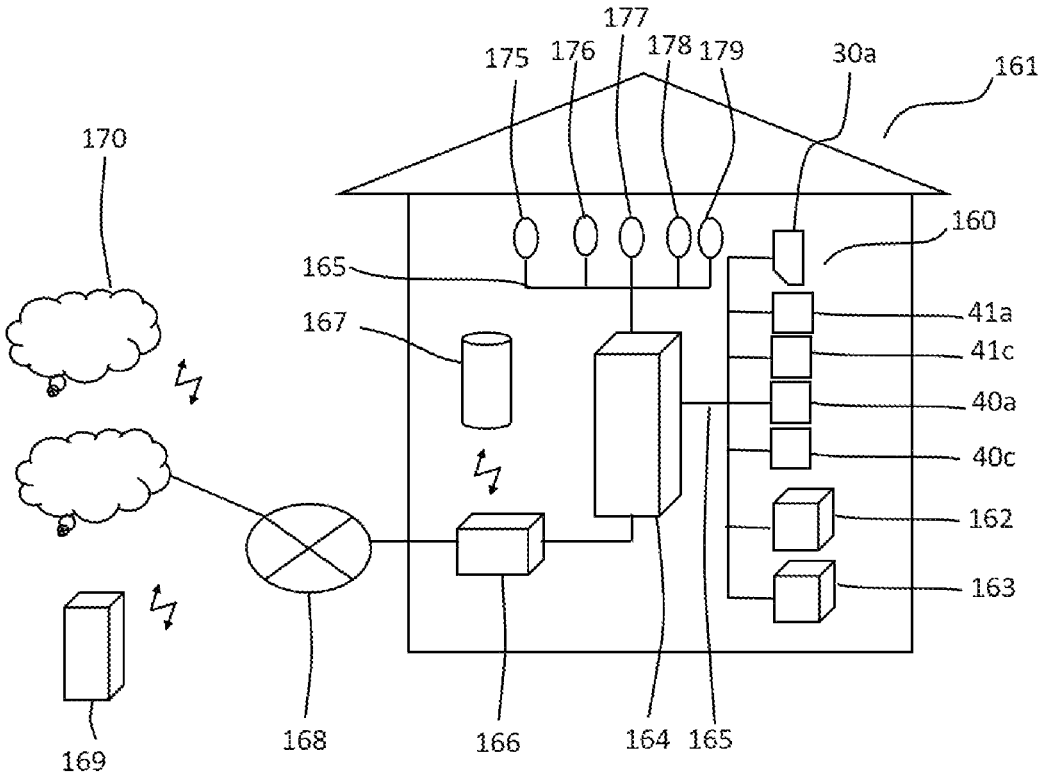

AIR CONDITIONING SYSTEM

TECHNICAL FIELD

The present invention relates to an air conditioning system which conditions air in a plurality of rooms in a building by an air conditioning section and a blowing section.

BACKGROUND TECHNIQUE

To realize energy-saving and comfort living in housings, further airtight and heat insulation in housings become popular. As an optimal highly air tight and well heat insulating housing, there is a whole-housing air conditioning system for sending air which is conditioned by an air conditioner to the entire housing.

Conventionally, in an air conditioning system of this kind, a return compartment which is in adjacent to a plurality of rooms is formed, the room is provided with an air intake section through which air sent from an air blower is blown out, an exhaust section for forming exhausting current flowing from the room toward the return compartment is formed between the room and the return compartment, and a plurality of air blowers and at least one air conditioning section are placed in the return compartment. A total blast volume of the plurality of air blowers is made greater than air conditioning blast volume of the air conditioning section. According to this, it is known to condition air in a plurality of rooms by an air conditioning section placed in the return compartment at uniform temperature and in an energy-saving manner (e.g., see patent document 1).

A housing having a plurality of rooms and a common space such as a hallway is provided with ventilation means placed in each of rooms for ventilating the room, and an air conditioning indoor unit which uses the common space as a chamber for supplying air to cool and heat the plurality of rooms, and the air conditioning indoor unit is placed under a roof or under a floor of the housing. It is known to substantially equally control the sum of air volumes of the plurality of ventilation means and a supply air volume of the air conditioning indoor unit, it is known to make it possible to individually condition air in some degree although the air conditioning is for a whole-housing (e.g., see patent document 2).

Another whole-housing air-conditioning system includes a heat source device, a dispensing device, a plurality of temperature sensors, and a control device. It is known that the control device acquire temperatures measured by the plurality of temperature sensors as current temperatures in a plurality of respective air conditioning spaces, and the control device controls the heat source device and the dispensing device such that a difference between the current temperature and target temperatures of the plurality of air conditioning spaces becomes small (e.g., see patent document 3).

Another whole-housing air-conditioning system includes an air mixing box, a plurality of conveying fans, an intake air temperature sensor, a conveyed air temperature sensor and a system controller. The air mixing box mixes air introduced from an outer air introduction port and air introduced from an inner air introduction port with each other. The conveying fans convey air in the air conditioning section and air in the air mixing box into a plurality of rooms, and each of the conveying fan is provided in each of the plurality of rooms. The system controller controls air volume of the conveying fan. This known whole-housing air-conditioning system includes a fan air volume control section which controls the blast volume of the conveying fan based on intake air temperature, conveyed air temperature and a predetermined threshold value (e.g., patent document 4).

In the case of a VAV system which conditions air in a plurality of areas, when indoor temperature of a certain area cannot reach an indoor temperature set value within specific time even if a damper of a VAV unit is fully opened, air volumes of the other areas are set minimum, and the air volume of the certain area is increased. Even though, if the indoor temperature of the area does not reach the indoor temperature set value, it is known that a supply air temperature set value is changed (e.g., patent document 5).

PRIOR ART DOCUMENTS

Patent Documents

[Patent Document 1] PCT International Publication No. 2018-073954

[Patent Document 2] Japanese Patent Application Laid-open No. H9-79648

[Patent Document 3] Japanese Patent Application Laid-open No. 2018-109462

[Patent Document 4] Japanese Patent Application Laid-open No. 2019-174103

[Patent Document 5] Japanese Patent Application Laid-open No. 2019-39630

SUMMARY OF THE INVENTION

Problem to be Solved by the Invention

According to the air conditioning system described in patent document 1, conditioned air having small different temperature from the room temperature is sent to each room with large air volume by the plurality of air blowers and with this, the temperature of the entire housing can be uniformed with saved energy by the system having relatively simple configuration. However, there is a problem that there is assumed no means to change the temperature of each of the rooms while saving energy based on individual's preference or to cope with load variation caused by variation in an amount of solar radiation or in the number of residents.

According to the air conditioning system described in patent document 2, the air volume of the ventilation means is changed based on the difference between the temperature of each room and the set temperature. Control is performed to substantially equalize the sum of the air volume of the plurality of ventilation means and the supplied air volume of the air conditioning indoor unit. Therefore, there is a problem that while conditioned air having a large difference between its temperature and the room temperature blown out from the air conditioning section passes through the common space and moved to the rooms, temperature of the conditioned air sent to the rooms is varied due to heat transfer, and it is difficult to set the temperature of the rooms to uniform values.

According to the whole-housing air-conditioning system described in patent document 3, the heat source device and the dispensing device are controlled such that differences between the current temperature and the target temperatures of the plurality of air-conditioned spaces become small. However, conditioned air having the large difference between the target temperature and the current temperature of air blown out from the heat source device passes through the dispensing device. According to this, the air volume is reduced, and while the air moves to the conditioned air spaces, the temperatures of the conditioned air sent to the conditioned air spaces are varied, and it is similarly difficult to uniform the temperature of the conditioned air spaces.

According to the whole-housing air-conditioning system described in patent document 4, the blast volume of the conveying fan is controlled based on the difference between the temperature of air taken into the air mixing box and temperature of air conveyed by the conveying fan. Therefore, there is a problem that it is not possible to change the temperature in respective rooms, and to cope with a load change caused by solar radiation.

According to the VAV system described in patent document 5, it is possible to bring indoor temperature of each area close to an indoor temperature set value, but an air volume of conditioned air having a large difference from room temperature is reduced by pressure loss of a damper, and the difference between the conditioned air and the room temperature is further increased by changing a supplied air temperature set value without increasing the entire air volume. Therefore, it is difficult to uniformly maintain the room temperature of each area while saving energy.

The present invention has been accomplished to solve the conventional problems, and it is an object of the invention to provide an air conditioning system having a relatively simple configuration, capable of changing temperature of each of rooms, and capable of coping with load variation caused by solar radiation or change in the number of residents based on individual's preference while setting the temperature of the entire housing to a comfortable and uniform value while saving energy.

Means for Solving the Problem

To achieve the above object, in an air conditioning system of the present invention, a return compartment which is adjacent to a plurality of rooms is formed in a building, the respective rooms are provided with air intake sections which spout air sent from a blowing section having a DC motor, an exhaust section which forms exhausting current directed from the respective rooms toward the return compartment is provided between the respective rooms and the return compartment, the plurality of blowing sections and at least one air conditioning section are placed in the return compartment, a total blast volume of the plurality of blowing sections is greater than a conditioned air volume of the air conditioning section, and a blast volume of the blowing section is adjusted by an air conditioning load of the room.

By this means, air which is discharged from the exhaust section of each room and which is conditioned by the air conditioning section and the discharged air which is not conditioned are sucked by the plurality of air blowers having the total blast volume which is greater than air volume of the conditioned air in the return compartment. According to this, the conditioned air and the discharged air are more reliably mixed with each other, and these airs become mixed conditioned air having uniform temperature of a small difference from the room temperature. This mixed air is sucked by the plurality of blowing sections having an efficient DC motor, and air is sent by the air intake section of each room. According to this, temperature of the entire housing can be uniformed with saved energy.

Further, when an air conditioning load of each room is varied by variation in the amount of solar radiation or in the number of residents, the number of rotations of the DC motor of the blowing section is adjusted in a wider range. According to this, it is possible to obtain a comfort air conditioning system in which the blast volume of the mixed conditioned air into each of the rooms can be adjusted with saved energy, and the influence of the amount of solar radiation and the number of residents on the temperature of the room can be reduced.

The air conditioning system further includes temperature setting means of the room and sucked temperature detecting means of the blowing section, wherein the air conditioning load of the room is determined by set temperature of the room and by sucked temperature of the blowing section, and the blast volume of the blowing section is adjusted.

According to this, temperature of each of the rooms can be set to individual's preference temperature, and mixed conditioned air obtained by mixing discharged air and conditioned air from each of the rooms is blown out in the return compartment from the air intake section of each of the rooms by the air blower which sends air into each of the rooms. Hence, temperature of the discharged air from each of the rooms and room temperature if each of the rooms are estimated from temperature of air sucked by the air blower, and an air conditioning load of each of the rooms is determined by set temperature of each of the rooms and the sucked temperature of the blowing section, and the blast volume of the blowing section is adjusted. Hence, it is possible to obtain the air conditioning system capable of bringing the temperature of each of the rooms to the set temperature more quickly and more reliably and with saved energy, and capable of making comfort space in accordance with individual's preference.

The air conditioning system further includes temperature setting means of the room and room temperature detecting means of the room, wherein the air conditioning load of the room is determined by set temperature and room temperature of the room, and the blast volume of the blowing section is adjusted.

According to this, it is possible to obtain the air conditioning system capable of more precisely determining the air conditioning load of each of the rooms from the room temperature of each of the rooms, capable of achieving set temperature of each of the rooms more quickly and more reliably with saved energy, and capable of making comfort space in accordance with individual's preference.

The air conditioning system further includes communicating means which connects the temperature setting means of the room and a public line to each other, wherein data is sent from a communication device connected to the public line through the communicating means, and set temperature of the temperature setting means of the room is determined based on the data.

According to this, it is possible to set temperature of each of the rooms from inside and outside communication devices of the building. Hence, when there is no temperature setting means near even in the building or when the person is out, it is possible to make a comfort space in accordance with individual's preference, and a convenient air conditioning system can be obtained.

The air conditioning system further includes temperature setting means of the return compartment, room temperature detecting means of the return compartment, and temperature setting means of the air conditioning section, wherein an air conditioning load of the return compartment is determined by set temperature and room temperature of the return compartment, and set temperature of the air conditioning section is adjusted.

According to this, an air conditioning load in the return compartment can quickly and precisely be determined from temperature of air in the return compartment sucked by the air conditioning section and the blowing section and from the set temperature, the set temperature of the air conditioning section can be adjusted, the ability of the air conditioning section is adjusted and suction temperature of the blowing section can also be adjusted. Hence, when it is not possible to cope with an air conditioning load of a room and when temperature of individual's preference cannot be obtained even if the blast volume of the blowing section is adjusted, it is possible to obtain an air conditioning system capable of more quickly and more reliably achieving the set temperature in each of the rooms and to make comfort space in accordance with individual's preference. Even if it is possible to sufficiently cope with the air conditioning load of the room and it is possible to set the room temperature to temperature of individual's preference, it is possible to obtain an air conditioning system capable of stabilizing the temperature to the individual's preference with more saved energy.

Effect of the Invention

According to the present invention, mixed conditioned air is sent to each of the rooms with large air volume by a plurality of blowing sections having a DC motor capable of controlling the number of rotations with a wide range with saved energy, and blast volume is adjusted by set temperature and the like of each of the rooms.

Therefore, it is possible to provide an air conditioning system capable of realizing comfort individual's preference temperature with saved energy, quickly and reliably in accordance with an air conditioning load.

By adjusting the set temperature of the air conditioning section, it is possible to adjust suction temperature of the blowing section in response to the air conditioning load of the return compartment. Hence, it is possible to obtain an air conditioning system capable of realizing individual's preference comfort temperature with saved energy, more quickly and more reliably.

The air conditioning system includes communicating means and a communication device capable of communicating inside and outside of a building. It is possible to realize individual's preference comfort temperature from the communication device more quickly and more reliably, and a convenient air conditioning system can be obtained.

BRIEF DESCRIPTION OF THE DRAWINGS

FIG. 1 is a plan view of a first floor of a building showing a configuration of an air conditioning system according to a first embodiment of the present invention;

FIG. 2 is a plan view of a second floor of the building;

FIG. 3 is an enlarged plan view of a stair case portion of the second floor of the building;

FIG. 4 is a sectional view of the stair case portion of the second floor of the building taken along a line A-A;

FIG. 5 is a sectional view of the stair case portion of the second floor of the building taken along a line B-B;

FIG. 6 is a perspective view of an air blower installing section;

FIG. 7 is a perspective exploded view of an air blower;

FIG. 8 is an electric circuit diagram of the air blower;

FIG. 9 is a diagram showing of an operating section of a temperature setting unit;

FIG. 10 is a flowchart 1 of adjustment of blast volume of the air blower;

FIG. 11 is a diagram showing a configuration of an air conditioning system in a second embodiment of the invention;

FIG. 12 is a flowchart 2 of adjustment of blast volume of the air blower;

FIG. 13 is a flowchart 3 of adjustment of blast volume of the air blower;

FIG. 14 is a flowchart of adjustment of set temperature of an air conditioner; and FIG. 15 is a diagram showing a control system of an air conditioning system in a third embodiment of the invention.

MODE FOR CARRYING OUT THE INVENTION

First Embodiment

FIG. 1 is a plan view of a first floor of a building showing a configuration of an air conditioning system according to a first embodiment of the present invention, and FIG. 2 is a plan view of a second floor of the building.

As shown in FIG. 1, an entrance 2, a living room 3, and a kitchen 4 are disposed and, a rest room 5, a bathroom 6, an undressing room 7 and the like are provided on the first floor of the building 1 which is a highly air tight and well heat insulating housing. The living room 3 is provided with stairs 8 to a second floor. A first floor ceiling of the building 1 is provided with spout grills (air intake sections) 9*a*, 9*b*, 9*c* and 9*d* for sending air into rooms on the first floor. One ends of first floor air ducts 10*a*, 10*b*, 10*c* and 10*d* are respectively connected to the spout grills 9*a*, 9*b*, 9*c* and 9*d*. The other ends of the first floor air ducts 10*a*, 10*b*, 10*c* and 10*d* are placed on the second floor. The spout grills 9*a*, 9*b*, 9*c* and 9*d* may be provided on a floor instead of the ceiling. When the spout grills 9*a*, 9*b*, 9*c* and 9*d* are provided on the floor, the first floor air ducts 10*a*, 10*b*, 10*c* and 10*d* are provided under the floor.

As shown in FIG. 2, a stair case 12 is placed on the second floor of the building 1. The stair case 12 is composed of stairs 8 from the first floor and hallway 11. Room A 13, room B 14 and room C 15 on the second floor of the building 1 are adjacent to the stair case 12. The room A 13 is provided with a storage room A16. The room B 14 is provided with a storage room B17. A ceiling 62 on the second floor of the building 1 is provided with spout grills (air intake sections) 18*a*, 18*b*, 18*c* and 18*d* which sends air into the rooms on the second floor. The ceiling 62 of the room A 13 on the second floor is provided with the spout grills (air intake sections) 18*a* and 18*b*. The ceiling 62 of the room B 14 on the second floor is provided with the spout grill (air intake section) 18*c*. The ceiling 62 of the room C 15 on the second floor is provided with the spout grill (air intake section) 18*d*.

As shown in FIG. 2, a stair case 12 composed of a corridor 11 and the stairs 8 leading from the first floor is disposed on the second floor of the building 1. A room A 13, a room B 14 and a room C 15 on the second floor of the building 1 are disposed next to the stair case 12. A closet A16 is provided in the room A 13. A closet B17 is provided in the room B 14. Spout grills (air intake sections) 18*a*, 18*b*, 18*c* and 18*d* which send wind into the rooms on the second floor are provided in a ceiling 62 on the second floor of the building 1. The spout grills (air intake sections) 18*a*, 18*b* are provided in the ceiling 62 of the room A 13 on the second floor. The (air intake section) 18*c* is provided in the ceiling 62 of the room B 14 on the second floor. The spout grill (air intake section) 18*d* is provided in the ceiling 62 of the room C 15 on the second floor.

One ends of second floor air ducts 19*a*, 19*b*, 19*c* and 19*d* are respectively connected to the spout grills (air intake sections) 18*a*, 18*b*, 18*c* and 18*d*. The spout grills (air intake sections) 18*a*, 18*b*, 18*c* and 18*d* may be provided in the floor instead of the ceiling 62. When the spout grills (air intake sections) 18*a*, 18*b*, 18*c* and 18*d* are provided in the floor, the second floor air ducts 19*a*, 19*b*, 19*c* and 19*d* are disposed under the floor of the second floor.

FIG. 3 is an enlarged plan view of a stair case portion of the second floor of the building of the air conditioning system in the embodiment, FIG. 4 is a sectional view taken along a line A-A in FIG. 2, and FIG. 5 is a sectional view taken along a line B-B in FIG. 2.

As shown in FIGS. 3 to 5, the stair case 12 is surrounded by a side wall 20 of the stairs 8, a wall A 21 reached when proceeding up the stairs 8 from the first floor, a partition wall 22 existing between the room A 13, room B 14 and room C 15 on the second floor, and a wall B 23 which is opposed to the wall A 21. A distance between the wall A 21 and the wall B 23 is about 3.8 m, and a width between the stairs 8 and the corridor 11 is about 0.9 m. Since a center size of a pillar in an architectural design drawing is used and a size in which a thickness of a wall is not taken into account is described, "about" is added to the sizes. This rule is applied also to the following size descriptions.

A handrail 24 is mounted on the corridor 11 on the side of the stairs 8. The handrail 24 is composed of a horizontal crosspiece 25 and vertical crosspieces 26. Slits 27 exist between the vertical crosspieces 26. A similar handrail 28 is mounted on the stairs 8 on the side of a space of the first floor.

An air conditioner (air conditioning section) 30*a* of the air conditioning system 29 is placed above the wall B 23 of the stair case 12 close to the sidewall 20. In the air conditioner 30*a*, a heat exchanger (not shown) which exchanges heat between refrigerant and air and conditioned air blower (not shown) are accommodated in an integral casing. The air conditioner 30*a* is a separate type air conditioner wall-mounted type indoor unit which is connected to an outdoor unit (not shown) having a compressor (not shown), a refrigerant pipe (not shown) and a signal line (not shown). The air conditioner 30*a* has a function, as conditioned air volume, to set blast volume of the indoor unit and air conditioned set temperature from 16° ° C. to 30° C. as strong wind, medium wind and weak wind. The indoor unit includes sucked air temperature sensor (not shown). The indoor unit controls inverter driving frequency of the compressor (not shown), an electric expansion valve (not shown) and an outdoor air blower (not shown) by sucked air temperature and set temperature such that the sucked air temperature comes close to the set temperature, enthalpy and an circulation amount of refrigerant which flows into the heat exchanger (not shown) are adjusted, and air conditioning ability of the air conditioner 30*a* is controlled. A suction port through which intake air current 32*a* is sucked is provided in an upper surface 31 of the air conditioner 30*a*. A spout port through which spout air current 33*a* is spouted is provided in a lower portion of a front surface of the air conditioner 30*a*. The spout port is provided with a vertical wind direction control plate 34. The vertical wind direction control plate 34 is set such that this spouts spout air current 33*a* substantially in a horizontal direction. Here, the expression "substantially in a horizontal direction" includes a downward direction within 15° from the horizontal direction. The spout port is provided with a horizontal wind direction control plate (not shown). The horizontal wind direction control plate is set such that this spouts spout air current 33*a* toward the wall A 21 substantially parallel to the side wall 20.

First floor air blowers (blowing sections) 40*a*, 40*b*, 40*c* and 40*d* and second floor air blowers (blowing sections) 41*a*, 41*b*, 41*c* and 41*d* of the air conditioning system 29 are mounted on the wall B 23. The first floor air blowers 40*a*, 40*b*, 40*c* and 40*d* and second floor air blowers 41*a*, 41*b*, 41*c* and 41*d* are placed below the air conditioner 30*a*. The four first floor air blowers 40 and the four second floor air blowers 41 are placed, one first floor air blower duct 10 is connected to one of the first floor air blowers 40, and one second floor air blower duct 19 is connected to one of the second floor air blowers 41.

A DC motor (direct current motor) 65 (see FIG. 7) and a sirocco fan 42 are provided in each of the first floor air blowers 40 and the second floor air blowers 41. Energy of the DC motor 65 is smaller than that of the AC motor, and the number of rotations of the DC motor can be controlled continuously or steplessly in a wider range than the AC motor. Air is sucked from the stair case 12 by rotation of the sirocco fan 42, the sucked air flows through the first floor air blower duct 10 and the second floor air blower duct 19 and the air is blown out into the rooms in the building 1. By sucking air from the stair case 12, intake air current 43 is generated. The sucked air flows through the first floor air blower duct 10 and the second floor air blower duct 19 as spout air current 44.

The first floor air blowers 40*a*, 40*b*, 40*c* and 40*d* and the second floor air blowers 41*a*, 41*b*, 41*c* and 41*d* include control devices 80 (see FIG. 8) as air volume adjusting means. The control device 80 can change the number of rotations of a fan continuously or steplessly.

The DC motor 65 is an efficient brushless DC motor having high durability.

Each of the roos A 13, room B 14, room C 15 on the second floor is provided with a lower clearance 51 of a door 50 which is an entrance from the stair case 12, and an exhaust section 52 located close to a ceiling 62 which is higher than the air conditioner 30*a* of the partition wall 22. Exhausting current 53 of the second floor is formed in the lower clearance 51 and the exhaust section 52. An opening which is in communication with the stair case 12 is provided in each of the rooms on the first floor. This opening corresponds to an exhaust section 55 to the stair case 12, and exhausting current 56 of the first floor is formed in this opening.

Hence, the stair case 12 becomes a return compartment where air groups discharged from the plurality of rooms in the building 1 which is composed of the living room 3, the kitchen 4, a room A 13, a room B 14 and a room C 15 merge with each other. That is, the stair case 12 which becomes the return compartment is adjacent to the living room 3, the kitchen 4, the room A 13, the room B 14 and the room C 15.

Blast air volumes of air which is sent to the living room 3, the kitchen 4, the room A 13, the room B 14 and the room C 15 are determined by volumes of the living room 3, the kitchen 4, the room A 13, the room B 14 and the room C 15. A total blast air volume (total blast air volume is called Vh hereinafter) which is total of the blast air volumes to the living room 3, the kitchen 4, the room A 13, the room B 14 and the room C 15 is calculated. Air-blowing ability and the number of blowers which send air to the living room 3, the kitchen 4, the room A 13, the room B 14 and the room C 15 are selected from the determined blast air volumes. In this embodiment, the blast duct composes a portion of the blower. That is, the blast air volume used for selecting the blower is a blast air volume of air which is spouted from the spout grill (air intake section) through the blast duct. The blast air volume which is required for conditioning air is preferably at least 8 $m^3$/h or more per 2.5 $m^3$ of the room and ideally, about 20 $m^3$/h, and the blast air volume is adjusted in accordance with a size and an air conditioning load such as solar radiation of the room.

The air-conditioning ability of the air conditioner 30*a* is determined by air conditioning load calculation concerning the building 1.

That is, the air conditioning load is calculated based on transferred heat from the wall, the window, the ceiling and the like, radiant heat of solar radiation which penetrates a window glass, heat and moisture generated from a resident existing in the room, heat generated from illumination and a machine tool, and heat quantity and moisture generated from air taken from outside and draft as the air conditioning load (Haruo YAMADA, "Freezing and air conditioning", Japan, Kabushiki Kaisha Yokendo, Mar. 20, 1975, pages 240 to 247). More room is given to this load calculation result, the air conditioner 30*a* of the entire building 1 is selected from air conditioning sections which are lineup in terms of ability, and the entire building 1 is air-conditioned.

An optimal conditioned air volume (optimal conditioned air volume is called Vq hereinafter) of the air conditioner 30*a* is determined from the total blast air volume Vh calculated in the total blast air volume calculating step.

The optimal conditioned air volume Vq is an air volume of 50% or less of the total blast air volume Vh, and is 70% or less at the most, and is an air volume where the air conditioner 30*a* can exhibit ability in accordance with the air conditioning load so that conditioned air and discharged air are reliably mixed with each other and mixed conditioned air of uniform temperature having a small temperature difference between the rooms is sent by the air blowers 40 and 41 such that a total blast volume is large.

The air conditioner 30*a* includes determined air-conditioning ability, and a model of the air conditioner 30*a* which can set a conditioned air volume which is equal to or less than the determined optimal conditioned air volume Vq is selected.

The conditioned air volume is volume of air which passes through the heat exchanger (not shown) of the air conditioner 30*a*. To avoid pressure loss caused by passage through the heat exchanger so that mixed conditioned air can be blown out into the rooms with large volume, if the air conditioning section includes an air trunk which bypasses the heat exchanger, volume of air of the bypass air trunk is removed from the conditioned air volume.

In this embodiment, a floor area of the building 1 is about 97.7 $m^2$, a height of the ceiling is 2.5 m, the air conditioner 30*a* having cooling ability corresponding to 4 kW is installed, and air of 700 $m^3$ is sent per hour at the time of cooling operation by cross flow fan in a weak wind mode. In each of the first floor blowers 40 and the second floor blowers 41, a blast air volume per one blower is set to about 150 $m^3$/h in an intermediate notch. The total blast air volume Vh which is sent into the building 1 in this embodiment is about 1200 $m^3$/h, and this is larger than the conditioned air volume of the air conditioner 30*a*. That is, in this embodiment, an air volume of 58% of the total blast air volume Vh is set as a conditioned air volume (weak wind mode) which can be set in the air conditioner 30*a*.

Blast volumes of the air blowers 40 and 41 can be adjusted continuously or steplessly from the minimum 100 $m^3$ per hour to the maximum 250 $m^3$ per hour by the air conditioning load of each of the rooms. The total blast volume as the minimum blast volumes of the air blowers 40 and 41 is 800 $m^3$ per hours and this is greater than the conditioned air volume 700 $m^3$ per hour of the air conditioner 30*a*.

FIG. 6 is a perspective view of the air blower installing section, FIG. 7 is a perspective exploded view of the air blower, FIG. 8 is an electric circuit diagram of the air blower, and FIG. 9 is a diagram showing of the operating section of the temperature setting unit.

As shown in FIG. 6, a first floor air blower (blowing section) 40*b* is mounted on the wall B 23, and a first floor air blower duct 10*b* is connected to the first floor air blower 40*b* in the wall B 23. Since the air blowers 40 and 41 are the same as the air blower 40*b*, description of the air blowers 40 and 41 other than the air blower 40*b* will be omitted, and only the air blower 40*b* will be described hereinafter as a representative.

A box-shaped main body case 70 and a louver 71 are detachably attached to the first floor air blower (blowing section) 40*b*. The louver 71 covers the main body case 70 from an upper surface of the wall B 23.

The louver 71 is provided with a inlet 72. The stair case 12, the main body case 70 and the first floor air blower duct 10*b* are connected to one another as air flow paths through an opening (not shown) of the wall B 23.

As shown in FIG. 7, the louver 71 is detachably attached to a mounting section 73 of the main body case 70 through mounting springs 74.

The DC motor 65 and the sirocco fan 42 are provided in the main body case 70. An electric component box 75 is provided on the side of the sirocco fan 42. An option mounting terminal 76 is connected between the main body case 70 and the louver 71 through the electric component box 75 and a lead wire 77.

The sirocco fan 42 sucks air from the louver 71 by rotation of the DC motor 65. The air is spouted into the living room 3 from the spout grill 9*b* through the air blower duct 10*b*.

A temperature sensor unit 78 and a temperature setting unit 79 (temperature setting section) which are a plurality of option units are detachably mounted on the option mounting terminal 76 such that the units 78 and 79 can be operated from front of the main body case 70 if the louver 71 is detached.

The temperature sensor unit 78 is a unit which detects sucked air temperature of the air blower 40*b*. The temperature setting unit 79 is a unit which sets temperature of air which is spouted from the spout grill 9*b* into the living room 3 by the air blower 40*b* through the air blower duct 10*b*.

A plurality of spout grills are provided in each of the rooms. If a plurality of air blowers are connected to the spout grill, the temperature setting unit 79 functions as a unit which sets temperature of a position near the spout grill in the room.

The control device 80 which controls the operation of the DC motor 65 is provided in the electric component box 75.

Control of the air blower 40*b* will be described based on an electric circuit diagram of the air blower in FIG. 8 and an operating section of a temperature setting unit in FIG. 9.

The control device 80 is provided with an air blower control section 81 which controls the operation of the DC motor 65 of the air blower 40*b* and with a power source 82 which supplies power source to the air blower control section 81.

The option mounting terminal 76 includes two connectors 88*a* and 88*b* for connecting the temperature sensor unit 78 and the temperature setting unit 79 (temperature setting section) to each other. These connectors 88*a* and 88*b* are connected to the power source 82 and the air blower control section 81 of the control device 80 through the lead wire 77. Power source is supplied from the power source 82 to the temperature sensor unit 78 and the temperature setting unit 79 through connectors 87*a* and 87*b* of the temperature sensor unit 78 and the temperature setting unit 79. Information is input from the temperature sensor unit 78 and the temperature setting unit 79 to the air blower control section 81.

The air blower control section 81 includes the temperature sensor unit 78 and a calculating section 83. The calculating section 83 calculates and determines blast air volume of the DC motor 65 using preset algorithm (control logic) based on information (detection information) which is input from the temperature setting unit 79. Details of the algorithm used by the calculating section 83 will be described later. The information of the blast air volume determined by the calculating section 83 is input to the air blower control section 81, and the air blower control section 81 controls the number of rotations of the DC motor 65.

The temperature sensor unit 78 includes a moisture sensor 85, a unit control section 84*a* which controls the detection operation of the moisture sensor 85, and a connector 87*a*.

The moisture sensor 85 has a function to detect temperature of air sucked from the louver 71 of the air blower 40*b*. For example, a sensor for converting variation of temperature into voltage, a resistance change type sensor or a variable capacity type sensor is used.

The unit control section 84*a* determines air volume which is operated by the DC motor 65 based on a detection signal from the moisture sensor 85, and outputs the same to the air blower control section 81. The unit control section 84*a* has a function to output, to the air blower control section 81, identification information capable of identifying that a signal is an output signal.

The temperature setting unit 79 includes a moisture setting section 86, a unit control section 84*b* which controls the detection operation of the moisture setting section 86, and a connector 87*b*, As shown in FIG. 9, the moisture setting section 86 includes an operating section 89 which sets temperature of air spouted by the air blower 40*b* into the room (living room 3), and the operating section 89 includes an SW 90 which can set temperature from 16° C. to 30° C. by rotation.

A dial type switch capable of setting the set temperature continuously or steplessly is used as the SW 90, but the switch is not limited to the dial type switch, and switches having various configurations may be used if the switch can set the switching.

To determine air volume which is operated by the DC motor 65 based on a detection signal from the moisture setting section 86, the unit control section 84*b* outputs the same to the air blower control section 81. The unit control section 84*b* has a function to output, to the air blower control section 81, identification information capable of identifying that a signal is an output signal from the moisture setting section.

In this embodiment, the air conditioning section is described as the air conditioner 30*a* in which the heat exchanger (not shown) and the conditioned air blower (not shown) are accommodated in the integral casing, the blowing section is described as the air blowers 40*a*, 40*b*, 40*c*, 40*d*, 41*a*, 41*b*, 41*c* and 41*d*, and the return compartment is described as the stair case 12 which is adjacent to the plurality of rooms. However, the return compartment may be a relatively narrow room of about one tsubo (unit of area) having four sides surrounded by insulated walls such as an air-conditioned room (not shown) which is in adjacent to a plurality of rooms, and the air conditioning section (air conditioning section) and the air blower (blowing section) may be provided in the narrow room.

Further, the return compartment is formed into a casing surrounded by sheet metals, and the casing is placed at a position which is in adjacent to a plurality of rooms. Only the heat exchanger is provided in the casing as the air conditioning section, and a plurality of air blowers are provided as blowing sections. Discharge air is made to passes through the heat exchanger by the plurality of air blowers to condition the air. Discharge air which bypasses the heat exchanger and does not pass through the heat exchanger and conditioned air are mixed in the casing to make mixed conditioned air. In this manner, the mixed conditioned air may be sent to the rooms.

The connectors 87*a* and 87*b* respectively provided in the option units 78 and 79 and the connectors 88*a* and 88*b* of the option mounting terminal 76 have common configurations so that they can be connected to each other.

Hence, arbitrary option units selected from a plurality of option units can be connected to the connectors 88*a* and 88*b* of the option mounting terminal 76. The option unit may include a temperature sensor, a moisture sensor, an outside air temperature sensor, a carbon dioxide sensor, a solar radiation sensor, a human detecting sensor, a temperature setting section, moisture setting section, a sensor setting section and the like. Once connected option unit can be disconnected and another option unit can be connected.

In the first embodiment, although a case where the temperature sensor unit 78 and the temperature setting unit 79 selected from these option units are mounted on the unit mounting terminal 76 is described as one example, other option unit may be mounted.

In the above description, although the two option units are selectively mounted on the unit mounting terminal 76, only one option unit or three or more option units may be mounted.

An outdoor unit extension unit (not shown) may be provided and connected so that the outdoor unit and the option mounting terminal 76 are provided at positions (e.g., ceiling of a room, location near a window or in a duct) other than the main body case 70 of the air blower 40*b*. The outdoor unit extension unit is composed of an option mounting pedestal, an extension lead wire, a connector and a cover which can be connected to the option mounting terminal 76.

Although a case where the air volume of the air blower 40*b* continuously or steplessly determines the air volume is described as an example, the air volume may be determined in a multistep manner.

In the above-described configuration, if the temperature of the air conditioner 30*a* is set and the device 30*a* is operated, the conditioned air blower (not shown) of the air conditioner 30*a* is operated. Temperature of the intake air current 32*a* is detected from sucked air temperature sensor (not shown) of the air conditioner 30*a*, an air conditioning load is determined from the sucked air temperature and the set temperature, inverter driving frequency of the compressor (not shown) of the outdoor unit (not shown), the electric expansion valve (not shown) and the outdoor air blower (not shown) are controlled. Enthalpy and a circulation amount of refrigerant which flows into the heat exchanger (not shown) are adjusted, and air-conditioning ability of the air conditioner 30*a* is controlled.

Conditioned air whose heat is exchanged with refrigerant in the heat exchanger becomes spout air current 33*a* of the air conditioner 30*a*, and it is spouted in a substantially horizontal direction and toward the wall A 21 in substantially parallel to the sidewall 20. If the first floor air blower 40 and the second floor air blower 41 are operated, intake air current 43 and spout air current 44 of the air blower are generated.

With respect to wind speed 3 to 5 m/S of the spout air current 33*a* of the air conditioner 30*a*, wind speed of the intake air current 43 of the air blower is about 0.4 m/s, and wind speed of the intake air current 43 of the air blower is slower than wind speed of the spout air current 33*a* of the air conditioner 30*a*. Further, since the spout air current 33*a* of the air conditioner 30*a* is sent by the cross flow fan, the spout air current 33*a* is prone to reach far away places, and the spout air current 33*a* is less prone to be sucked by the intake air current 43 of air blower which is generated when surrounding air is sucked by the operation of the sirocco fan 42. Therefore, most of the spout air current 33*a* of the air conditioner 30*a* reaches a place near the wall A 21 while diffusing, the most spout air current 33*a* is inverted and returns to a direction of the wall B 23 along the stairs 8, the most spout air current 33*a* merges with the intake air current 43 of the air blower having much blast volume and they are mixed, and become mixed conditioned air. Hence, if a suction openings of the first floor air blower 40 and the second floor air blower 41 are provided while avoiding a spouting direction of the spout air current 33*a* from the air conditioner 30*a*, conditioned air circulation air current 45 which circulates and diffuses in the stair case 12 is formed, and short circuit is less prone to be generated.

Specific gravity of the spout air current 33*a* at the time of heating operation is lighter than that of the spout air current 33*a* at the time of cooling operation, and the former spout air current 33*a* is prone to rise. Hence, it is preferable that a direction of the spout air current 33*a* at the time of the heating operation is directed downward as compared with the direction of the spout air current 33*a* at the time of the cooling operation so that the spout air current 33*a* is sent substantially in the horizontal direction.

If wind is sent to the plurality of rooms of the building 1, portions of discharged air from the second floor room A 13, room B 14 and room C 15 return to the stair case 12 as the second floor exhausting current 53, and discharged air from the first floor rooms return to the stair case 12 as the first floor exhausting current 56. At that time, since the exhaust section 52 opens in the vicinity of the ceiling 62, most of the second floor exhausting current 53 forms air-conditioning returning air current 57 which flows toward the air conditioner 30*a* along the ceiling 62, and this merges with the intake air current 32*a* of the air conditioner 30*a*. Hence, the air conditioner 30*a* detects temperature of air which is close to the room temperature, and operation of the air conditioner 30*a* is controlled. A position of the exhaust section 52 is not limited only if it is conducted to the stair case 12, but if the exhaust section 52 is located close to the ceiling 62 of the stair case 12 and close to the air conditioner 30*a*, more exhausting current 53 is sucked into the air conditioner 30*a*, and temperature of the intake air current 32*a* becomes close to the room temperature, a difference between the set temperature when the air conditioner 30*a* is operated and actual temperature in the building 1 is small, and operation is controlled.

Until the conditioned air circulation air current 45 is inverted, it flows in a direction opposed to the exhausting current 53 and the intake air current 43, and the conditioned air circulation air current 45 involves surrounding air and diffuses. Therefore, as the conditioned air circulation air current 45 flows, temperature of the conditioned air circulation air current 45 becomes higher than temperature of the spout air current 33*a* of the air conditioner 30*a* at the time of the cooling operation, and the temperature of the conditioned air circulation air current 45 becomes lower than the temperature of the spout air current 33*a* at the time of the heating operation.

The conditioned air circulation air current 45 is formed mainly on the side of the stairs 8 of the stair case 12, and the air-conditioning returning air current 57 is formed mainly on the side of the second floor hallway 11 of the stair case 12. Further, since the total blast volume sent to the room of the building 1 is greater than the conditioned air volume, the spout air current 33*a* of the air conditioner 30*a*, the first floor exhaust current 56 and the second floor exhausting current 53 are sufficiently mixed, and they become mixed conditioned air. The heat exchanger air blowers 40 and 41 suck the mixed conditioned air and blow out the same into the room, a difference between the temperature of the conditioned air circulation air current 45 and the temperature of the rooms become smaller.

Air flows through the handrail 24 or the slits 27 of the handrail 28, and the flow of the air helps the mixing operation. A portion of the first floor exhaust current 56 merges also with the air-conditioning returning air current 57 from a boundary between the stairs 8 and the hallway 11. To make it easy to merge the air current from the first floor with the hallway 11, a ventilation slit (not shown) for conducting between the first floor and the second floor of the building 1 may be provided.

A temperature difference between the temperature of the spout air current 44 which is blown into the room and room temperature of the room becomes smaller than a temperature difference between temperature of the spout air current 33*a* of the air conditioner 30*a* and temperature of the room. Hence, since people staying in the room are less prone to feel stress caused by the temperature difference between the temperature of the room and room temperature of the spout air current 44, comfortableness is enhanced.

When conditioned air volume of the indoor unit is constant, the air conditioner which controls the number of rotations of the compressor by the inverter of the embodiment is operated such that a difference between the spouting temperature and the room temperature becomes small when the air conditioning load is small. Hence, when the air conditioning load is small and the room temperature is stable, since comfortableness is not deteriorated even if the blast volume into the room is made small, there is no problem even if the total blast volume Vh is made small and the conditioned air volume becomes equal to or greater than 100% or greater of the total blast volume Vh only if the operating time is not so long.

It is unnecessary that all of the air conditioner 30*a*, the first floor air blower 40 and the second floor air blower 41 are placed on the wall B 23. A portion of the air blower may be placed on the first floor of the stair case 12, or the portion of the air blower may be provided on the partitioning wall 22.

According to the air conditioning system of the embodiment, since the total blast volume Vh into the rooms is greater than the conditioned air volume, a portion of the discharged air which returns to the return compartment from the rooms is sucked into the air conditioner 30*a*. Remaining discharged air is sufficiently mixed with the spouted air of the air conditioner 30*a* in the return compartment and conditioned, and the air becomes mixed conditioned air.

If blast volumes of the air blowers 40 and 41 are adjusted by air volume adjusting means, it is possible to cope with variations of the air conditioning load of the room per the air blowers 40 and 41.

Next, operation action of the air blower 40*b* will be described using a blast volume adjusting flowchart of the air blower shown in FIG. 10.

If power is applied to the power source 82 of the air blower 40*b*, the air blower 40*b* starts operating, the temperature sensor unit 78 and the temperature setting unit 79 detect suction temperature of the air blower 40*b* by the unit control sections 84*a* and 84*b*, and set temperature of the room is identified.

Next, the information is input to the calculating section 83. The calculating section 83 sets the identified set temperature as a target value inputs suction temperature of the detected air blower, determines an air conditioning load of the room blown out by the air blower, and performs PID control while using the blast volume (number of rotations) of each of the air blowers as an operation amount.

Concerning the air conditioning load of each of the rooms, since the building 1 is highly air tight and well heat insulating housing and heat insulating properties and airtightness of a wall which faces outdoor are excellent, outside air load is small and influence of invasion heat of an adjacent room is the largest. Temperature in the building 1 is prone to be uniform entirely due to large blast volumes of the air blowers 40 and 41, discharged air from each of the rooms directly enters the stair case 12 which is the return compartment from the exhaust section 52, and the discharged air is sucked into the air blowers 40 and 41. Since the conditioned air volume is smaller than the total blast volume, even if conditioned air and discharged air are mixed with each other, temperature gradient of room temperature of each of the rooms and sucked temperature of the air blowers 40 and 41 is small. Hence, temperature of discharged air from each of the rooms and room temperature of each of the rooms are estimated from the temperature of air sucked by the air blowers 40 and 41, and the air conditioning load is simply obtained by means of multiplying a temperature difference between the sucked temperature of the air blowers and the set temperature of the room by a constant.

However, to more precisely calculate the air conditioning load, the option unit extension unit (not shown) is connected, the option mounting terminal 76 is provided at a place where the outdoor temperature can be detected, e.g., in the air-supply duct of the outdoor air, and an outside air temperature sensor (not shown) is provided as an option unit. Signal communication is conducted between the air blowers 40 and 41, outside air temperature information is input to the calculating section 83, and outside air load caused by the temperature difference between the outside air temperature and the set temperature may be added to the air conditioning load.

Further, a solar radiation sensor (not shown) is provided near a window of each of the rooms, signal communication is conducted between the air blowers 40 and 41, solar radiation amount information from the window is input to the calculating section 83, the solar radiation load is added to the air conditioning load, the ceiling of each of the rooms is provided with a human detecting sensor (not shown), signal communication is conducted between the air blowers 40 and 41, information concerning resident is input to the calculating section 83, and a human body load of the resident may be added to the air conditioning load.

The determined blast volume (number of rotations) is input to the air blower control section 81, and the DC motor 65 is rotated at the determined number of rotations.

Normally, the number of rotations and the blast volume are in a proportional relation, and the number of rotations of the DC motor 65 is controlled such that the blast volume stays between the minimum 100 $m^3$ per hour to the maximum 250 $m^3$ per hour. Generally, the DC motor 65 has a wide control range from minimum to maximum number of rotations as compared with an AC motor, the number of rotations and power consumption are in a proportional relation, and if the blast volume (number of rotations) is reduced, power consumption is also reduced. Therefore, a difference of power consumption is large as compared with an AC motor especially at minimum blast volume, and the power consumption is less than 5 W which is extremely small.

As a difference between the set temperature and the room temperature estimated from the sucked temperature is larger, and as the air conditioning load is larger, the room temperature comes close to the set temperature by increasing the blast volumes of the air blowers 40 and 41.

For example, in winter, when the sucked temperature is 30° C. and the estimated room temperature is 14° C. and the set temperature is 20° C., since the air conditioning load is large, the blast volumes of the air blowers 40 and 41 are increased to 250 $m^3$ per hour which is the maximum air volume, and the room temperature of the room is brought close to the set temperature 20° C. In summer, when sucked temperature is 23° C. and estimated room temperature is 32° C. and the set temperature is 28° C., since the cooled air conditioning load is large, the blast volumes of the air blowers 40 and 41 are increased to 250 $m^3$ per hour which is the maximum air volume, and the room temperature of the room is brought close to the set temperature 28° C.

As a difference between the room temperature estimated from the sucked temperature and the set temperature is smaller, and as the air conditioning load is smaller, the blast volumes of the air blowers 40 and 41 are reduced, and as the room temperature comes close to the set temperature, the number of rotations of the DC motor 65 is reduced, the power consumption is also reduced, energy is further saved, and it stabilized near the set temperature.

For example, in winter, when sucked temperature is 30° C. and estimated room temperature is 14° C. and the set temperature is 16° C., since the heated air conditioning load is small, the blast volumes of the air blowers 40 and 41 are reduced to 100 $m^3$ per hour which is the minimum air volume, and the room temperature of the room is stabilized at the set temperature 16° ° C. In summer, when the sucked temperature is 23° C. and the estimated room temperature is 32° C. and the set temperature is 30° C., since the cooled air conditioning load is small, the blast volumes of the air blowers 40 and 41 are reduced to 100 $m^3$ per hour which is the minimum air volume, and the room temperature of the room is stabilized at the set temperature 30° C.

In this manner, in the stair case 12 (return compartment), conditioned air which is conditioned discharged air from the exhaust section 52 of the room by the air conditioner 30*a* and discharged air which is not conditioned are sucked into the plurality of air blowers 40 and 41 having blast volume which is greater than air volume of the conditioned air. According to this, the conditioned air and the discharged air are reliably mixed with each other, and they become mixed conditioned air having a small difference from the room temperature and having uniform temperature. The control range of the number of rotations of the blowing sections 40 and 41 is wide and the blowing sections include efficient DC motor 65. Air is sucked by the blowing sections 40 and 41 and the air is sent by the spout grills (air intake sections) 9*a*, 9*b*, 9*c* and 9*d* of the rooms. According to this, temperature of the entire house can be uniform with saved energy.

Further, when the air conditioning load of the room is varied by variation of the solar radiation amount, the number of residents, the blast volume of mixed conditioned air to the room is adjusted in a wider range with saved energy by adjusting the number of rotations if the DC motor 65 of the air blowers 40 and 41 in a wider range, it is possible to reduce influence of temperature of each of the rooms, the solar radiation amount and the number of residents, and a comfort space can be made.

Temperature can be set to individual's preference temperature per each of the rooms by the temperature setting unit 89, and mixed conditioned air which is obtained by mixing the discharged air from the rooms and the conditioned air with each other is blown out from the spout grills 9*a*, 9*b*, 9*c* and 9*d* of each of the rooms by the air blowers 40 and 41 which send air to the rooms. Hence, temperature of discharged air from the room and the room temperature are estimated from temperature of air sucked by the air blowers 40 and 41, the air conditioning load of each room is determined by set temperature of the room and the sucked temperature of the air blowers 40 and 41, and the blast volumes of the air blowers 40 and 41 are adjusted. Hence, it is possible to bring the temperature of each room close to the set temperature more quickly and more reliably with saved energy, and it is possible to form a comfort space satisfying individual's preference.

Further, the minimum number of rotations of the DC motor 65 is the minimum blast volume 100 $m^3$ per hour of the blast volume of the air blower. Therefore, even the total minimum blast volume 800 $m^3$ per hour of the plurality of air blowers is greater than the conditioned air volume 700 $m^3$ per hour of the air conditioning section 30*b*, the conditioned air and the discharged air are reliably mixed with each other, the mixed conditioned air has uniform temperature having a small temperature difference from the room temperature, the mixed conditioned air is sucked into the air blowers and is sent to the rooms. Therefore, temperature of each of the rooms is conditioned to uniform temperature with smaller energy by the operation of the DC motor 65 of the air blowers 40 and 41 with minimum number of rotations.

If the total blast volume becomes smaller than the conditioned air volume due to failure of the air blowers 40 and 41, and the building 1 is a highly air tight and well heat insulating housing. Therefore, if mixed conditioned air is circulating in the entire building 1 when the air blowers are operated for long time and air conditioning operation is stable, influence on the temperature of the room and comfortableness is small if the operating time is as short as one hour.

Suppose that there is an obstacle in the stair case (return compartment) 12, short circuit is generated, conditioned air and discharged air are not mixed with each other sufficiently and a temperature difference is generated by a position of the stair case 12 caused by solar radiation from a window of the stair case 12 and temperature of air sucked by the plurality of air blowers 40 and 41 is largely varied. Even if such things occur, blast volume is adjusted in accordance with respective suction temperatures, temperature in each of the rooms comes close to the set temperature.

When there is no resident in the house or temperature of the room when air conditioning operation is started is not stable, if the adjustment of the blast volume is started at the maximum air volume, temperature of the room comes close to the set temperature early. When temperature of the room is stable when a resident stays in the room or when the operation is continued for a long time, if blast volume when the adjustment of the blast volume is started is set to minimum air volume, draft feeling is not easily felt, and this is comfortable.

An air volume setting SW (not shown) may separately be connected to the air blower, blast volume of the air blower may be set by the air volume setting SW, and when the air volume setting SW (not shown) is automatically set, the operation may be controlled in accordance with the above-described flow.

In this embodiment, the room temperature of the room is estimated from the suction temperature of the air blower, and the air conditioning load of the room is determined based on the suction temperature and the set temperature of the room. However, the moisture sensor (not shown) and the moisture setting section (not shown) are added as option units, suction moisture of the air blower is detected, moisture in the room is estimated, and set moisture in the room is identified. According to this, the air conditioning load in the room may be determined at the time of the cooling operation especially in summer based on the suction temperature and suction moisture of the air blower and set temperature and set moisture in the room.

Second Embodiment

FIG. 11 is a diagram showing a configuration of an air conditioning system in a second embodiment of the invention, FIG. 12 is a flowchart 2 of adjustment of blast volume of the air blower, FIG. 13 is a flowchart 3 of adjustment of blast volume of the air blower, and FIG. 14 is a flowchart of adjustment of set temperature of an air conditioner.

An air conditioning system 100 shown in FIG. 11 is provided in a building 101. Basic configurations of the air conditioning system 100 are the same as those of the air conditioning system 29 provided in the building 1 of the first embodiment. To simplify the description, the same numbers are allocated to the same constituent elements, and partial constituent elements are omitted. That is, in FIG. 11, the air conditioning system 100 and the building 101 have four rooms, air in the rooms is conditioned, but the number of the rooms and the number of air blowers are not limited to those of the building 101.

Ceilings of a living room 3 and a kitchen 4 in a first floor of the building 101 are provided with spout grills (air intake sections) 9*a* and 9*c* which send wind into the rooms on the first floor. One ends of first floor air blower ducts 10*a* and 10*c* are respectively connected to the spout grills 9*a* and 9*c*.

Second floor room A 13 and room B 14 of the building 101 are placed in adjacent to a stair case 12. Ceilings of the room A 13 and the room B 14 are provided with spout grills (air intake sections) 18*a* and 18*c* which send air into second floor rooms. One ends of the second floor air blower ducts 19*a* and 19*c* are respectively connected to the spout grills 18*a* and 18*c*.

The stair case 12 which is the return compartment is provided with an air conditioner (air conditioning section) 30*a* of the air conditioning system 100, first floor air blowers (blowing sections) 40*a* and 40*c* and second floor air blowers (blowing sections) 41*a* and 41*c*.

The first floor air blowers 40*a* and 40*c* and the second floor air blowers 41*a* and 41*c* are mounted on the other ends of the first floor air blower duct 10*a* and 10*c* and the second floor air blower ducts 19*a* and 19*c*.

The living room 3, the kitchen 4, the room A 13 and the room B 14 are respectively provided with remote controllers 110, 111, 112 and 113 which can operate the air conditioning system 100 in each of the rooms. The stair case 12 which is the return compartment is provided with a centralized remote controller 115 which is electrically connected to the remote controllers 110, 111, 112 and 113, the air conditioner 30*a* and the air blowers 40*a*, 40*c*, 41*a* and 41*c*.

The remote controllers 110, 111, 112 and 113 and the centralized remote controller 115 include temperature sensor 120, 121, 122, 123 and 125. And the temperature sensor 120, 121, 122, 123 and 125 detect room temperature of the living room 3, the kitchen 4, the room A 13, the room B 14 and the stair case 12.

The heat exchanger remote controllers 110, 111, 112 and 113 and the centralized remote controller 115 includes SWs 130, 131, 132, 133 and 135 which set temperature of the living room 3, the kitchen 4, the room A 13, the room B 14 and the stair case 12. The SWs can set temperature from 16° C. to 30° C. by rotation.

The remote controllers 110, 111, 112 and 113 and the centralized remote controller 115 are connected to each other through signal lines 140, 141, 142 and 143. Information of room temperature detected by the temperature sensors 120, 121, 122 and 123 of the return compartment and information of set temperature which are set by the SWs 130, 131, 132 and 133 are communicated therebetween.

The centralized remote controller 115, the air conditioner 30*a* and the air blowers 40*a*, 40*c*, 41*a* and 41*c* are connected to each other through signal lines 145, 146, 147, 148 and 149, and the set temperature and the blast volume of the air conditioner 30*a* and the blast volumes of the air blowers 40*a*, 40*c*, 41*a* and 41*c* are adjusted by communication.

A display 150 of the centralized remote controller 115 can check set temperature and room temperature of the remote controllers 110, 111, 112 and 113 and the centralized remote controller 115 by communication, and the set temperature of the remote controllers 110, 111, 112 and 113 can be changed by communication by the SW 135.

In the above-described configuration, the centralized remote controller 115 sets temperature of the stair case 12, and the remote controllers 110, 111, 112 and 113 set temperature of the rooms to operate the air conditioner 30*a*. According to this, the air conditioner 30*a* sucks discharged air, carries out air conditioning operation such as cooling operation and heating operation, and blows out conditioned air. The conditioned air is mixed with other discharged air in the stair case 12, they become mixed conditioned air, and this is sucked by rotation of the DC motors 65 of the air blowers 40*a*, 40*c*, 41*a* and 41*c*. The mixed conditioned air passes through the first floor air blower ducts 10*a* and 10*c* and second floor air blower ducts 19*a* and 19*c*, the mixed conditioned air is blown out into the living room 3, the kitchen 4, the room A 13 and the room B 14 from the spout grills 9*a*, 9*c*, 18*a* and 18*c*, the mixed conditioned air conditions air in the rooms, the mixed conditioned air becomes discharged air and returns to the stair case 12 which is the return compartment.

Like the first embodiment, the total blast volume of the plurality of air blower is greater than conditioned air volume of the air conditioner 30*a*, conditioned air and discharged air are reliably mixed with each other, they become mixed conditioned air of uniform temperature having a small temperature difference from the room temperature, the mixed conditioned air is sucked into the air blower, and the air is sent to the rooms. Therefore, temperature of the rooms become uniform with saved energy, and air in the room is conditioned.

Next, operation action of the air blower will be described using a blast volume adjustment flowchart of the air blower shown in FIG. 12.

If power is supplied, operation of the air blower is started, and room temperatures of the living room 3, the kitchen 4, the room A 13 and the room B 14 are detected by the temperature sensors 120, 121, 122 and 123 provided in the remote controllers 110, 111, 112 and 113. The SWs 130, 131, 132 and 133 of the remote controllers 110, 111, 112 and 113 recognize set temperatures of the set living room 3, kitchen 4, room A 13 and room B 14.

Room temperatures of the rooms and information of the set temperatures are communicated with the concentration remote controller 115 by the signal lines 140, 141, 142 and 143. The control section (not shown) of the centralized remote controller 115 determines the air conditioning load of each of the rooms based on the information, and performs PID control of the blast volume (number of rotations) of each of the air blower as an operation amount.

Since the building 101 is a highly air tight and well heat insulating housing properties and airtightness of the wall which faces outdoor are excellent. Therefore, an outside air load is small and influence of invasion heat from the adjacent room is the largest. Therefore, the air conditioning load of each room is obtained by multiplying a temperature difference between the room temperature of the room and the set temperature by a constant.

In the second embodiment, the temperature sensors 120, 121, 122 and 123 provided in the remote controllers 110, 111, 112 and 113 detect room temperatures of the living room 3, the kitchen 4, the room A 13 and the room B 14, the SWs 130, 131, 132 and 133 recognize the set temperatures of the rooms, the centralized remote controller 115 determines the air conditioning loads of the rooms, and adjust the blast volumes of the air blowers. However, like the first embodiment, the option unit extension unit (not shown) is connected to the option mounting terminal 76 of the air blowers 40 and 41, the option mounting terminal 76 is provided at a position where room temperatures of the rooms can be detected, e.g., the option mounting terminal 76 is provided near doors of the rooms for example, the temperature sensor unit 78 and the temperature setting unit 79 are connected to the option mounting terminal 76, and signal communication is carried out between the air blowers 40 and 41. Information of the room temperature and the set temperature is input to the calculating section 83, a temperature difference between the room temperature of the room and the set temperature are multiplied by a constant, and the air conditioning loads of the rooms may be obtained. In this case, the remote controllers 110, 111, 112 and 113 and the centralized remote controller 115 are unnecessary.

To calculate the air conditioning load more precisely, outside air temperature sensor (not shown) may be provided, outside air temperature information may be input to the centralized remote controller 115, and an outside air load caused by a temperature difference between the outside air temperature and the set temperature may be added to the air conditioning load. Further, each of the rooms may be provided with a solar radiation sensor (not shown), a solar radiation amount information from a window may be input to the centralized remote controller 115, and the solar radiation load may be added to the air conditioning load. Each of the rooms may be provided with a human detecting sensor (not shown), resident information may be input to the centralized remote controller 115, and a human body load of the resident may be added to the air conditioning load.

The determined blast volume (number of rotations) is input to the air blower control section (not shown) of each of the air blowers 40 and 41, the DC motor 65 is rotated at the determined number of rotations.

The air conditioning load of each of the rooms is determined by the room temperature of the room and the set temperature, the number of rotations of the DC motor 65 is controlled, and the blast volume of each of the air blowers 40 and 41 is PID controlled. Therefore, as the difference between the room temperature and the set temperature is larger and the air conditioning load is larger, the room temperature comes close to the set temperature by increasing the blast volumes of the air blowers 40 and 41.

For example, when the room temperature is 14° C. and the set temperature is 20° C. in winder, since the heating air conditioning load is large, blast volume of the air blower 40 is increased to the maximum air volume of 250 $m^3$ per hour, and the room temperature is brought close to the set temperature 20° C. quickly. When the room temperature is 32° C. and the set temperature is 28° C. in summer, since the cooling air conditioning load is large, blast volumes of the air blowers 40 and 41 are increased to the maximum air volume 250 $m^3$ per hour, and the room temperature is brought close to the set temperature 28° C. quickly.

As the difference between the room temperature and the set temperature is smaller and the air conditioning load is smaller, the blast volumes of the air blowers 40 and 41 are reduced, and as the room temperature comes closer to the set temperature, the number of rotations of the DC motor 65 is reduced, the power consumption is also reduced, energy is more saved, and the temperature is stabilized near the set temperature.

For example, when the room temperature is 14° C. and the set temperature is 16° C. in winder, since the heating air conditioning load is small, blast volumes of the air blowers 40 and 41 are reduced to the minimum air volume of 100 $m^3$ per hour, and the room temperature is stabilized at the set temperature 16° C. For example when the room temperature is 32° C. and the set temperature is 30° C. in summer, since the cooling air conditioning load is small, blast volumes of the air blowers 40 and 41 are reduced to the minimum air volume of 100 $m^3$ per hour, and the room temperature is stabilized at the set temperature 30° C.

According to this, it is possible to more precisely determine the air conditioning loads of the rooms from the room temperatures of the rooms, it is possible to set the temperature of each room to the set temperature more quickly and more reliably with saved energy, and it is possible to form a comfort space satisfying individual's preference.

Next, operation of action of another air blower will be described using a blast volume flowchart 3 of the air blower shown in FIG. 13. While blast volumes (number of rotations) of the air blowers 40 and 41 are PID controlled, room temperature of a room is detected and set temperature of the room is recognized. When the room temperature is higher than the set temperature and a rising rate of the room temperature is high at the time of the heating operation, and when the room temperature is lower than the set temperature and a reducing rate of the room temperature is high at the time of the cooling operation, the blast volumes of the air blowers 40 and 41 are set to maximum air volumes. Otherwise, the PID control of the blast volume (number of rotations) of the air blowers 40 and 41 is continued.

For example, when the room temperature is 26° C. and the set temperature is 20° C. and the rising rate of the room temperature is 2K or more for 10 minutes in winter, the blast volumes of the air blowers 40 and 41 are set to the maximum air volume of 250 $m^3$ per hour. If a partial room temperature abruptly rises and it becomes equal to or higher than the set temperature for some reason such as a fact that the solar radiation amount is increased or another heating device is operated, its amount of heat is recovered and this is used for heating another room, the blast volumes of the air blowers 40 and 41 can be made maximum, a large amount of air in that room is returned to the return compartment quickly, and wind is sent to each room. According to this, it is possible to heat the other room with saved energy. Otherwise, PID control is performed based on the blast volume adjustment flowchart 2 of the air blower shown in FIG. 12.

When the room temperature is 24° C. and the set temperature is 28° C. and a reducing rate of the room temperature is 1 K or more for 10 minutes in summer, the blast volumes of the air blowers 40 and 41 are set to maximum air volume 250 $m^3$ per hour. If temperature of a partial room abruptly drops for some reason such as a fact another air conditioning system is operated, and the room temperature becomes equal to or lower than the set temperature, the amount of heat is recovered, and the temperature is used for cooling another room. Hence, the blast volumes of the air blowers 40 and 41 are set to the maximum, a large amount of air in that room is returned to the return compartment quickly, and wind is sent to the rooms. According to this, the other room can be cooled with saved energy. Otherwise, PID control is performed based on the blast volume adjustment flowchart 2 of the air blower shown in FIG. 12.

Next, operation of action of the air conditioner 30*a* will be described using a set temperature adjustment flowchart of the air conditioning section shown in FIG. 14.

If power is applied to the air conditioner 30*a*, the air conditioner 30*a* starts operating, and a room temperature of the stair case 12 which is the return compartment is detected by a temperature sensor 125 provided in the centralized remote controller 115.

Set temperature of the stair case 12 which is the set return compartment is recognized by an SW 135 of the centralized remote controller 115.

In the control section (not shown) of the centralized remote controller 115, the air conditioning load of the stair case 12 which is the return compartment is determined based on it, and PID control is performed using the set temperature of the air conditioner 30*a* as an operation amount.

Concerning the air conditioning load of the stair case 12, since the building 101 is highly air tight and well heat insulating housing and airtightness of the wall which faces outdoor are excellent. Therefore, an outside air load is small and influence of the invasion heat from an adjacent room is the largest. Therefore, the air conditioning load is simply obtained by multiplying a temperature difference between the room temperature of the stair case 12 and the set temperature by a constant.

However, to calculate the air conditioning load more precisely, an outside air temperature sensor (not shown) may be provided, signal communication may be conducted with the centralized remote controller 115, outside air temperature information may be input, and an outside air load obtained by the temperature difference between the outside air temperature and the set temperature may be added to the air conditioning load. Further, the stair case 12 may be provided with a solar radiation sensor (not shown), signal communication may be conducted with the centralized remote controller 115, a solar radiation amount from a window may be input, and a solar radiation load may be added to the air conditioning load.

The determined set temperature is input to the air conditioning control section (not shown) of the air conditioner 30*a*, the compressor (not shown), the electric expansion valve (not shown) and the like are controlled together with sucked air temperature information, and the air-conditioning ability is controlled. Usually, a difference between the sucked air temperature and the set temperature has a proportional relation with the air-conditioning ability.

For example, when room temperature of the stair case 12 is 14° C. and the set temperature is 20° C. in winter, since the heating air conditioning load is large, the set temperature of the air conditioner 30*a* is set to high as high as 26° ° C., and the room temperature of the stair case 12 is brought close to the set temperature 20° C. When the room temperature of the stair case 12 is 32° C. and the set temperature is 28° C. in summer, since the cooling air conditioning load is large, the set temperature of the air conditioner 30*a* is set to low as low as 20° C., and the room temperature of the stair case 12 is brought close to the set temperature 28° C.

As a difference between the room temperature of the stair case 12 and the set temperature is smaller and the air conditioning load becomes smaller, the suction air temperature of the air conditioner 30*a* also comes close to the set temperature, power consumption of the compressor of the air conditioner 30*a* is also reduced, energy is more saved and the temperature is stabilized at the set temperature.

For example, when the room temperature of the stair case 12 is 14° C. and the set temperature is 16° C. in winter, since the heating air conditioning load is small, the set temperature of the air conditioner 30*a* is set to low as low as 22° C., and the room temperature of the stair case 12 is stabilized at the set temperature 16° C. When the room temperature of the stair case 12 is 32° C. and the set temperature is 30° ° C. in summer, since the cooling air conditioning load is small, the set temperature of the air conditioner 30*a* is set to high as high as 22° C., and the room temperature of the stair case 12 is stabilized at the set temperature 30° C.

The air conditioning load of the stair case 12 (return compartment) is determined by the room temperature of the stair case 12 (return compartment) and the set temperature, and the set temperature of the air conditioner 30*a* is PID controlled. Therefore, as a result, the air-conditioning ability of the air conditioner 30*a* is controlled, and the room temperature of the stair case 12 (return compartment) comes close to the set temperature. The temperature of the stair case 12 (return compartment) becomes the average temperature of mixed conditioned air in which discharged air after each room is air-conditioned and conditioned air merge with each other. Hence, when the air conditioning load of each room is large, temperature becomes higher temperature at the time of the cooling operation, and the temperature becomes lower at the time of the heating operation. Depending upon the set temperature of the air conditioner 30*a*, the air-conditioning ability becomes deficient, and the temperature does not come close to the set temperature of the stair case 12 (return compartment). In such a case, the room temperature of the stair case 12 (return compartment) is brought close to the set temperature more quickly and more reliably, and the room temperature of each rooms also comes close to the set temperature quickly and reliably. When the temperature is stabilized, necessary air-conditioning ability of the air conditioner 30*a* is also lowered, the number of rotations of the compressor and the number of rotations of the DC motor 65 is reduced, the power consumption is also reduced, energy is more saved, and the temperature is stabilized near the set temperature.

In this manner, the air conditioning load of the stair case 12 (return compartment) is determined quickly and precisely from the set temperature and the temperature of air of the stair case 12 (return compartment) sucked by the air conditioner 30*a* and the air blowers 40 and 41, and the set temperature of the air conditioner 30*a* is adjusted. According to this, the ability of the air conditioner 30*a* is adjusted, and suction temperatures of the air blowers 40 and 41 are also adjusted. Therefore, when it is not possible to cope with the air conditioning load of the room and temperature cannot be set to individual's preference temperature even if the blast volumes of the air blowers 40 and 41 are adjusted, it is possible to set the temperature of each room to the set temperature and it is possible to form a comfort space satisfying individual's preference more quickly and more reliably. Even when it is possible to sufficiently meet the air conditioning load of each room and to set temperature of the room to the individual's preference temperature, it is possible to stabilize temperature at the individual's preference temperature while further saving energy.

At timing (time) of blast volume adjusting flows of the air blowers 40 and 41 and timing (time) of set temperature adjusting flow of the air conditioner 30*a*, blast volume adjusting flows are frequently carried out, and the set temperature adjusting flow is carried out occasionally. If the set temperature of the air conditioner 30*a* is frequently adjusted, blast volume extends over the entire house, and this prevents the power consumption from increasing.

Examples of the timing (time), the following 1 to 4 are indicated. In any case, the actual optimal timing (time) differs depending upon an air conditioning load of a building, ability of the air conditioning system, blast volume of the air blower and the like. Hence, a preferable configuration is that the centralized remote controller 115, the remote controllers 110, 111, 112 and 113 or the air blowers 40 and 41 is provided with a timing SW, and the timing (time) can be changed by the timing SW.

1) The blast volume adjustment flows of the air blowers 40 and 41 are carried out every five minutes, and the set temperature adjustment flow of the air conditioner 30*a* is carried out every one hour.

2) Within 24 hours after the air conditioning operation is started, the operation 1) is carried out and thereafter, the blast volume adjustment flows of the air blowers 40 and 41 are carried out every ten minutes, and the set temperature adjustment flow of the air conditioner 30*a* is carried out every two hours.

3) The blast volume adjustment flows of the air blowers 40 and 41 are carried out every five minutes, and when time during which a difference between the room temperature of each room and set temperature is equal to or greater than a certain threshold value is continued for one hour or longer, the set temperature adjustment flow of the air conditioner 30*a* is started and thereafter, it is carried out every ten minutes until the difference becomes smaller than the threshold value.

4) Within 24 hours after the air conditioning operation is started, the operation 3) is carried out and thereafter, the blast volume adjustment flows of the air blowers 40 and 41 are carried out every 10 minutes, when time during which a difference between the room temperature of each room and set temperature is equal to or greater than a certain threshold value is continued for one hour or longer, the set temperature adjustment flow of the air conditioner 30*a* is started and thereafter, it is carried out every twenty minutes until the difference becomes smaller than the threshold value.

Although the set temperature of the air conditioner 30*a* and the blast volumes of the air blowers 40*a*, 40*c*, 41*a* and 41*c* are controlled by the centralized remote controller 115, they may be directly controlled by the remote controllers 110, 111, 112 and 113 without providing the centralized remote controller 115. On the contrary, temperature sensors which detects room temperatures of the rooms are separately provided without providing the remote controllers 110, 111, 112 and 113, their signals are communicated with the centralized remote controller 115, the centralized remote controller 115 sets set temperatures of the rooms, and the air conditioner 30*a* and the air blowers 40*a*, 40*c*, 41*a* and 41*c* may be controlled.

Communication between the centralized remote controller 115 and the remote controllers 110, 111, 112 and 113 is carried out through the signal lines 140, 141, 142 and 143 by wire, communication between the centralized remote controller 115 and the air blowers 40*a*, 40*c*, 41*a* and 41*c* is carried out through the signal lines 146, 147, 148 and 149 by wire, and communication between the centralized remote controller 115 and the air conditioner 30*a* is carried out through the signal line 145 by wire. However, wireless communication sections may be provided and the communication may be carried out wirelessly such as Wi-Fi (registered trademark) or Bluetooth (registered trademark).

Third Embodiment

FIG. 15 is a control system diagram of an air conditioning system in a third embodiment of the invention.

The air conditioning system 160 shown in FIG. 15 is provided in a building 161. Basic configurations of the air conditioning system 29 provided in the building 1 of the first embodiment and the air conditioning system 100 provided in the building 101 are the same with each other. To simplify the description, the same numbers are allocated to the same constituent elements, and partial constituent elements are omitted.

An air conditioner (air conditioning section) 30*a*, first floor air blowers (blowing sections) 40*a* and 40*c* and second floor air blowers (blowing sections) 41*a* and 41*c* of the air conditioning system 160 are provided in a return compartment (not shown) in the building 161. A range hood 162 is provided in a kitchen (not shown), and a ventilatory device such as a heating/drying ventilation fan 163 is provided in a bathroom. Operation information thereof is input, and operation information is output. According to this, they are connected to each other through a communication line 164 and an HEMS (Home Energy Management System) remote controller 165 whose operation can be controlled.

Four rooms, i.e., a living room (not shown), a kitchen (not shown), and a room A (not shown) and a room B (not shown) are in the building 161. Each of the rooms includes a spout grill (not shown) for blowing mixed conditioned air through ducts (not shown) connected to air blowers 40*a*, 40*c*, 41*a* and 41*c*, and temperature sensors 175, 176, 177 and 178 which detect room temperatures of the rooms.

The return compartment (not shown) includes a temperature sensor 179 for detecting room temperature of the return compartment.

An HEMS remote controller 164 is connected to the temperature sensors 175, 176, 177, 178 and 179 and a communication line 165, and room temperature information of the rooms and the return compartment is input to the HEMS remote controller 164.

The HEMS remote controller 164 includes set temperature setting means (not shown) of the rooms and the return compartment.

The HEMS remote controller 164 includes a communication device (communication means) 166, and the communication device 166 is connected to a public line 168. Information such as input and output of operation information can be communicated between the HEMS remote controller 164 and outside of the building, e.g., communication device (smartphone, cell-phone, personal computer, tablet, car navigator and the like) 169 and a server 170.

The HEMS remote controller 164 includes an AI speaker (communication device) 167 having AI assistant function carried out voice recognition by duologue which is connected to the communication device 166 wirelessly, and it is connected to an outside server 170 through the public line 168, and the HEMS remote controller 164 can communicate, with the HEMS remote controller 164, information by sound such as input and output of operation information.

In the above-described configuration, temperatures of the return compartment and the rooms are set by the temperature setting means (not shown) of the HEMS remote controller 164, and the air conditioner 30*a* and the air blowers 40*a*, 40*c*, 41*a* and 41*c* are operated. According to this, like the second embodiment, air conditioning loads of the return compartment and the rooms are determined by room temperature information of the return compartment and the rooms from the temperature sensors 175, 176, 177, 178 and 179 and by the set temperatures made by the temperature setting means (not shown). The set temperature of the air conditioner 30*a* and the blast volumes of the air blowers 40*a*, 40*c*, 41*a* and 41*c* are adjusted by the air conditioning loads, and room temperatures of the rooms are brought close to the set temperature which satisfies individual's preference quickly and reliably.

The set temperatures of the rooms and the return compartment are changed by voice from the AI speaker (communication device) 167, it is unnecessary to operate the HEMS remote controller 164 every time, and convenience is excellent and comfortableness can be enhanced.

When there is no person, it is also possible to change, from outside, the set temperatures of the rooms and the return compartment by instructions from the communication device 169 such as a cell-phone or the like for save energy, and the temperature can be stabilized at the room temperature which satisfies the individual's preference when the person comes back.

According to this, it is possible to set temperatures of the rooms from the communication device 169 inside and outside of the building, and when there is no temperature setting means near the person even in the building or when the person is out, a room can be made as a comfortable space which satisfies individual's preference, and convenience is enhanced.

Further, data can be communicated with outside server 170, set temperatures of the rooms and the return compartment can be changed on accordance with electric power condition and weather of that area, and it is possible to control the operation into comfortable operation with saved energy as individual with stable electric power as that area.

Only the instructions of the set temperatures of the rooms and the return compartment are described in this embodiment. However, not only the temperature setting, it is also possible to instruct and change the operation/stop, the operation mode, and air volume, wind direction and the like of the air conditioning section and the air blower.

The HEMS remote controller 164 and the temperature sensors (not shown) which detect room temperatures of the rooms are connected to each other. In addition to this, the outside air temperature sensor (not shown) which detects outside air temperature, the solar radiation sensor (not shown) which detects the solar radiation amount of each room, and the human detecting sensor (not shown) which detects existence of a person in each room may also be connected, the HEMS remote controller 164 determines the air conditioning load of each room by the set temperature, the room temperature of each room, the outside air temperature, the solar radiation amount and the number of persons staying in the room, and the blast volumes of the air blowers 40*a*, 40*c*, 41*a* and 41*c* may be adjusted.

The HEMS remote controller 164 and the temperature sensor (not shown) which detects the room temperature of the return compartment are connected to each other. In addition to this, an outside air temperature sensor (not shown) which detects temperature of outside air and the solar radiation sensor (not shown) which detects the solar radiation amount are also connected to each other, and the HEMS remote controller 164 may determine the air conditioning load of the return compartment by the set temperature and the room temperature of the return compartment, the outside air temperature and the solar radiation amount, and the set temperature of the air conditioning section may be adjusted.

Further, a consumer electronics appliance such as an IH stove and a lighting device may be connected to the HEMS remote controller 164 and the operation may be carried out.

The HEMS remote controller 164 may be connected to a solar battery, an electric accumulator, a power conditioner, a power measuring device and the like, and the devices may be controlled with saved energy and efficiently by power consumption of the devices, generated power of the solar battery, and accumulated power of the electric accumulator.

The communication method may be carried out by wire or wireless.

INDUSTRIAL APPLICABILITY

The present system can create an efficient air flow in the entire building, and can create comfortable space in accordance with individual's preference. The present system can be applied to air conditioning of a housing area where a plurality of buildings are adjacent to one another, collective housing where a plurality of rooms are adjacent to one another, an office building where a plurality of companies are accommodated, a commercial establishment where a plurality of stores are accommodated, and a hospital.

EXPLANATION OF SYMBOLS

1 building
2 entrance
3 living room
4 kitchen
5 rest room
6 bathroom
7 washroom dressing room
8 stairs
9*a*, 9*b*, 9*c* and 9*d* spout grill (air intake section)
10*a*, 10*b*, 10*c* and 10*d* first floor air blower duct
11 hallway
12 stair case
13 room A
14 room B
15 room C
16 storage room A
17 storage room B
18*a*, 18*b*, 18*c*, 18*d* spout grill (air intake section)
19*a*, 19*b*, 19*c*, 19*d* second floor air blower duct sidewall
21 wall A
22 partition wall
23 wall B
24 handrail
25 horizontal rail
26 vertical rail
27 slit
28 handrail
29 air conditioning system
30*a* air conditioner (air conditioning section)
31 upper surface
32*a* intake air current
33*a* spout air current
34 vertical wind direction control plate
40*a*, 40*b*, 40*c*, 40*d* first floor air blower (blowing section)
41*a*, 41*b*, 41*c*, 41*d* second floor air blower (blowing section)
42 sirocco fan
43 intake air current
44 spout air current
45 conditioned air circulation air current
50 door
51 lower gap
52 exhaust section
53 exhausting current
55 exhaust section
56 exhausting current
57 air-conditioning returning air current
62 ceiling
65 DC motor (direct current motor)
70 main body case
71 louver
72 inlet
73 mounting section
74 mounting spring
75 electric component box
76 option mounting terminal
77 lead wire
78 temperature sensor unit
79 temperature setting unit (temperature setting section)
80 control device
81 air blower control section
82 power source
83 calculating section
84*a*, 84*b* unit control section
85 moisture sensor
86 moisture setting section
87*a*, 87*b* connector
88*a*, 88*b* connector
89 operating section
90 SW
100 air conditioning ventilation system
101 building
110, 111, 112, 113 remote controller
115 centralized remote controller
120, 121, 122, 123, 125 temperature sensor
130, 131, 132, 133, 135 SW
140, 141, 142, 143 signal lines
145, 146, 147, 148, 149 signal lines
150 display
160 air conditioning system
161 building

162 range hood
163 heating/drying ventilation fan
164 HEMS (Home Energy Management System) remote controller
165 communication line
166 communication device
167 AI speaker
168 public line
169 communication device (smartphone, cell-phone, personal computer, tablet, car navigator and the like)
170 server
175, 176, 177, 178, 179 temperature sensor

The invention claimed is:

1. An air conditioning system in which an air conditioning room which is adjacent to a plurality of rooms is formed in an air tight and heat insulating building, the rooms are provided with air intake sections which spout air sent from a plurality of blowing sections having a DC motor, an exhaust section which forms exhausting current directed from the rooms toward the air conditioning room is provided between the rooms and the air conditioning room, the plurality of the blowing sections and an air conditioning section are placed in the air conditioning room, the plurality of blowing sections are placed below the air conditioning section, the plurality of blowing sections and the air intake sections are connected to each other through a duct, spout air current that the air conditioning section conditioned by intaking the exhausting current is diffused and merged and mixed with intake air current of the plurality of blowing sections in the air conditioning room, and a temperature difference between room temperature and temperature of spout air current spouted into the rooms is smaller than a temperature difference between temperature of the spout air current from the air conditioning section and the room temperature, wherein a control device which controls operation of the DC motor is provided in each of the plurality of blowing sections, and a blast volume setting SW1 that can manually switch the blast volume of the plurality of blowing sections is connected, the plurality of blowing sections are controlled by the blast volume setting SW1 such that the blast volume becomes between a minimum air volume and a maximum air volume, and the minimum air volume is not zero, the blast volume of an air conditioning in the air conditioning section is less than 100% of the total blast volume of the plurality of blowing sections, even if the blast volume of the plurality of plurality of blowing sections is set to each of the minimum air volume of the plurality of the plurality of blowing sections, a temperature detecting means which detects intake air temperature and a setting means of the blast volume of the air conditioning and a temperature of the air conditioning of the air conditioning section are provided in the air conditioning section, and an air conditioning ability is controlled by a suction air temperature and an air conditioning setting temperature, and the room temperature of the room is adjusted to the setting temperature of the room by the blast volume of the plurality of blowing sections and the air conditioning ability of the air conditioning section.

2. The air conditioning system according to claim 1, further comprising a home energy management system (HEMS) remote controller connected to the air conditioning section, and communicating means which connects a public line to the HEMS remote controller, wherein data is sent from the communication device connected to the public line through the communicating means, and the air conditioning section determines the air conditioning setting temperature based on the data.

3. The air conditioning system according to claim 1, further comprising a home energy management system (HEMS) remote controller connected to the blowing sections, and communicating means which connects a public line to the HEMS remote controller, wherein data is sent from the communication device connected to the public line through the communicating means, and the blowing sections determine the blast volume based on the data.

* * * * *